US006409566B1

(12) United States Patent
Hasegawa et al.

(10) Patent No.: US 6,409,566 B1
(45) Date of Patent: Jun. 25, 2002

(54) METHOD OF MANUFACTURING AN ELECTRON SOURCE AND IMAGE FORMING APPARATUS USING THE SAME

(75) Inventors: Mitsutoshi Hasegawa, Yokohama; Yoshiyuki Osada, Atsugi; Hisaaki Kawade, Yokohama; Yuji Kasanuki, Isehara; Hideshi Kawasaki, Machida; Yoshimasa Okamura, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/945,619

(22) Filed: Sep. 5, 2001

Related U.S. Application Data

(62) Division of application No. 09/275,437, filed on Mar. 24, 1999, now Pat. No. 6,313,571, which is a division of application No. 08/906,093, filed on Aug. 5, 1997, now Pat. No. 5,912,531, which is a continuation of application No. 08/223,531, filed on Apr. 5, 1994, now abandoned.

(30) Foreign Application Priority Data

| | | |
|---|---|---|
| Apr. 5, 1993 | (JP) | 5-100127 |
| Apr. 5, 1993 | (JP) | 5-100128 |
| Apr. 5, 1993 | (JP) | 5-100129 |
| Dec. 28, 1993 | (JP) | 5-349133 |
| Mar. 29, 1994 | (JP) | 6-081159 |

(51) Int. Cl.[7] ..... H01J 9/00; H01J 9/24

(52) U.S. Cl. ..... 445/24; 313/495; 313/306; 313/309

(58) Field of Search ..... 313/495, 496, 313/497, 309, 306, 310, 336, 351, 355, 346 R, 422; 315/169.1, 169.3; 445/24, 25

(56) References Cited

U.S. PATENT DOCUMENTS

| | | | | |
|---|---|---|---|---|
| 5,066,883 | A | 11/1991 | Yoshioka et al. | 313/309 |
| 5,285,129 | A | 2/1994 | Takeda et al. | 313/309 |
| 5,315,206 | A | 5/1994 | Yoshida | 313/306 |
| 5,932,963 | A * | 8/1999 | Nakamura et al. | 313/495 |
| 6,144,166 | A * | 11/2000 | Nakamura et al. | 313/495 |
| 6,288,494 | B1 * | 9/2001 | Tsukamoto et al. | 313/306 |
| 2001/0020733 | A1 * | 9/2001 | Sasaguri | 257/653 |

FOREIGN PATENT DOCUMENTS

| | | |
|---|---|---|
| EP | 0 301 545 | 2/1989 |
| EP | 0 523 702 | 1/1993 |
| JP | 64-31332 | 2/1989 |
| JP | 1-257552 | 10/1989 |
| JP | 1-279557 | 11/1989 |
| JP | 1-283749 | 11/1989 |
| JP | 3-20941 | 1/1991 |
| JP | 4-264337 | 9/1992 |

OTHER PUBLICATIONS

H. Araki, et al., "Electroforming and Electron Emission of Carbon Thin Films", Journal of the Vacuum Society of Japan, vol. 26, No. 1, pp. 22–29 (Sep. 1981).

(List continued on next page.)

*Primary Examiner*—Kenneth J. Ramsey
*Assistant Examiner*—Mariceli Santiago
(74) *Attorney, Agent, or Firm*—Fitzpatrick, Cella, Harper & Scinto

(57) ABSTRACT

An electron source comprises a substrate, at least one row-directional wire, at least one column-directional wire intersecting the row-directional wire, at least one insulation layer arranged at the intersection of the row-directional wire and the column-directional wire, and at least one conductive film having an electron-emitting region also arranged at the intersection. The insulation layer is arranged between the row-directional wire and the column-directional wire and the conductive film is connected to both wires.

2 Claims, 27 Drawing Sheets

OTHER PUBLICATIONS

M. Hartwell, et al., "Strong electron Emission From Patterned Tin–Indium Oxide Thin Films", International Electron Devices Meeting, pp. 519–521 (1975).

C. Mead, "Operation of Tunnel–Emission Devices", Journal of Applied Physics, vol. 32, No. 4, pp. 646–652 (Apr. 1961).

C.A. Spindt, et al., "Physical Properties of Thin–Film Field Emission Cathodes With Molybdenum Cones", Journal of Applied Physics, vol. 47, No. 12, pp. 5248–5263 (Dec. 1976).

M.I. Elinson, et al., "The Emission Of Hot Electrons And The Field Emission Of Electrons From Tin Oxide", Radio Engineering And Electronic Phsyics, No. 7, pp. 1290–1296 (Jul. 1965).

W.P. Dyke, et al., "Field Emission", Advances in Electronics and Electron Physics, vol. VIII, pp. 89–185 (1956).

* cited by examiner

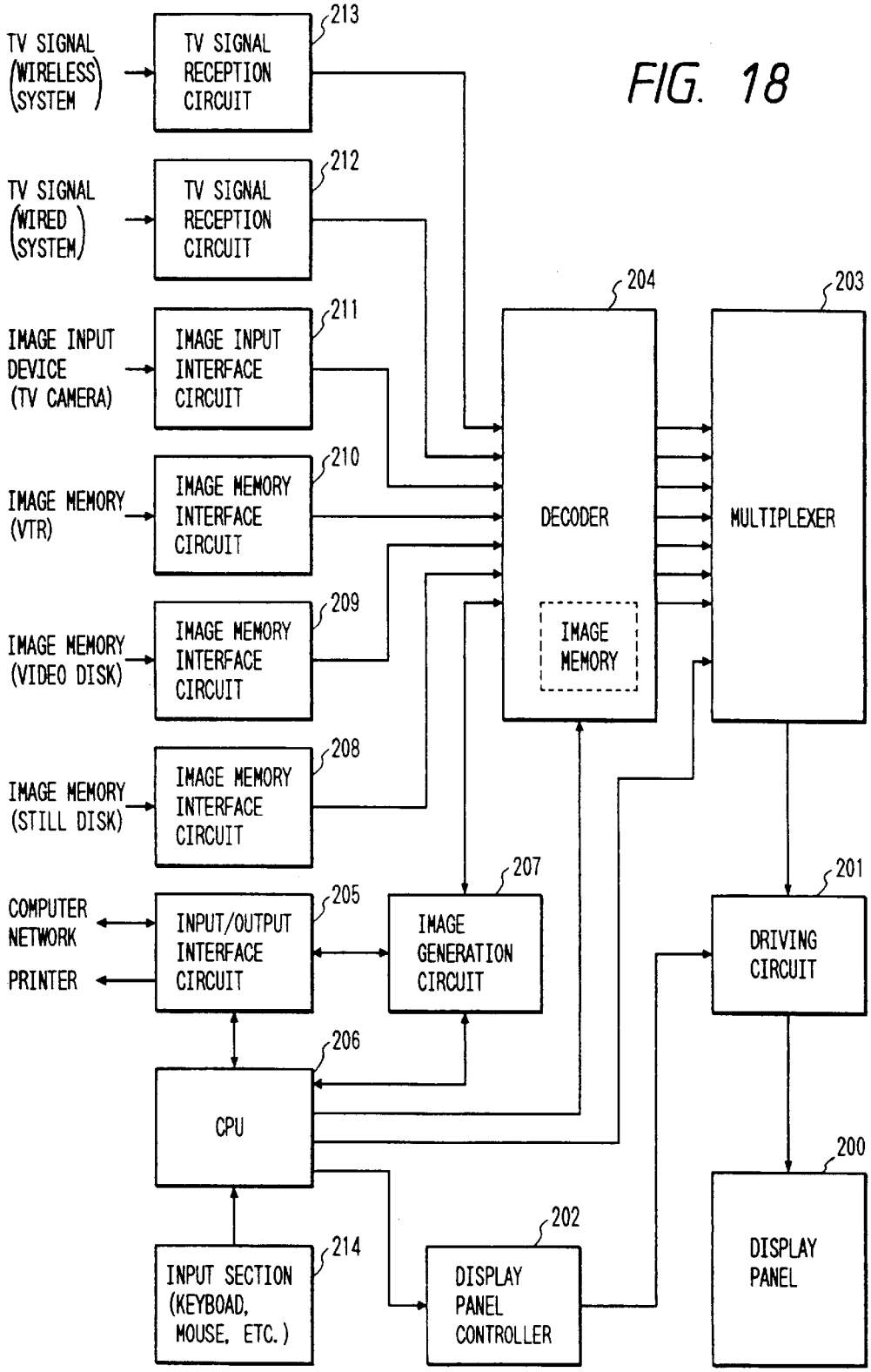
FIG. 18
TV SIGNAL (WIRELESS SYSTEM)
TV SIGNAL RECEPTION CIRCUIT
213
TV SIGNAL (WIRED SYSTEM)
TV SIGNAL RECEPTION CIRCUIT
212
IMAGE INPUT DEVICE (TV CAMERA)
IMAGE INPUT INTERFACE CIRCUIT
211
IMAGE MEMORY (VTR)
IMAGE MEMORY INTERFACE CIRCUIT
210
IMAGE MEMORY (VIDEO DISK)
IMAGE MEMORY INTERFACE CIRCUIT
209
IMAGE MEMORY (STILL DISK)
IMAGE MEMORY INTERFACE CIRCUIT
208
COMPUTER NETWORK
PRINTER
INPUT/OUTPUT INTERFACE CIRCUIT
205
IMAGE GENERATION CIRCUIT
207
CPU
206
INPUT SECTION (KEYBOAD, MOUSE, ETC.)
214
DISPLAY PANEL CONTROLLER
202
DECODER
IMAGE MEMORY
204
MULTIPLEXER
203
DRIVING CIRCUIT
201
DISPLAY PANEL
200

METHOD OF MANUFACTURING AN ELECTRON SOURCE AND IMAGE FORMING APPARATUS USING THE SAME

This is a divisional application of application Ser. No. 09/275,437, filed on Mar. 24, 1999, now U.S. Pat. No. 6,313,571, which is a divisional of application Ser. No. 08/906,093, filed on Aug. 5, 1997, now U.S. Pat. No. 5,912,531, issued on Jun. 15, 1999 which is a continuation of application Ser. No. 08/223,531, filed on Apr. 5, 1994 abandoned.

BACKGROUND OF THE INVENTION

1. Field of the Invention

This invention relates to an electron source and an image-forming apparatus realized by using the same and, more particularly, it relates to an electron source comprising a plurality of surface conduction electron emitting devices and an image-forming apparatus realized by using the same.

2. Related Background Art

Thermoelectron sources and cold cathode electron sources are known as two types of electron emitting devices. Electron emitting devices that can be used for cold cathode electrode sources include those of field emission type (hereinafter referred to as FE type), metal/insulation layer/metal type (hereinafter referred to as MIN type) and surface conduction type.

Examples of FE type devices are proposed in W. P. Dyke & W. W. Dolan, "Field emission", Advance in Electron Physics, 8, 89 (1956), A. Spindt, "PHYSICAL Properties of thin-film field emission cathode with molybdenum cones", J. Appln. Phys., 47, 5248 (1976). An MIN type device is disclosed in C. A. Mead, "The tunnel emission amplifier", J. Appln. Phys., 32, 646 (1961). A surface conduction electron-emitting device is proposed in M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface. While Elinson proposes the use of a $SnO_2$ thin film for a device of this type, the use of an Au thin film is proposed in G. Dittmer: "Thin Solid Films", 9, 317 (1972), whereas the use of an $In_2O_3/SnO_2$ Thin film and that of a carbon thin film are discussed respectively in M. Hartwell and C. G. Fonstad: "IEEE Trans. ED Conf.", 519 (1975) and H. Araki et al.: "Vacuum", Vol. 26, No. 1, p. 22 (1983).

FIG. 31 of the accompanying drawings schematically illustrates a typical surface conduction electron-emitting device proposed by M. Hartwell. In FIG. 31, reference numbers 311, 313 and 314 respectively denote an insulator substrate, an electron-emitting region and a thin metal oxide film including said electron-emitting region, whereas reference numerals 315 and 316 denote device electrodes that are made of a material common with that of the thin film 314. Referring to FIG. 31, the thin metal oxide film has a length $L_1$ of 0.5 to 1 mm and a width W of 0.1 mm. Note that the electron-emitting region 313 is only very schematically shown there.

A surface conduction electron-emitting device having a configuration as described above is normally prepared by producing an H-shaped thin metal oxide film, part of which eventually makes an electron-emitting region, on an insulator substrate 311 by means of sputtering and then the thin oxide film is partly transformed into an electron-emitting region 313 by using a process of preliminarily energizing the thin film which is generally referred to as "forming". In a forming process, a voltage is applied to given opposite ends of a thin film for preparing an electron-emitting region so that a part of the thin film may be destructed, deformed or transformed to become an electron-emitting region 313 which is electrically highly resistive as a result of energizing.

The electron-emitting region 313 of the surface conduction electron-emitting device produced by the forming process normally has fissures in part of the thin film and electrons are emitted from those fissures when a voltage is applied to the thin film 314 to cause an electric current flow therethrough.

However, known surface conduction electron-emitting devices having a configuration as described above have a number of problems to be solved if they are to be used for practical applications.

Surface conduction electron-emitting devices are, on the other hand, advantageous in that they can be formed in arrays in great numbers over a large area because they are structurally simple and hence can be manufactured at low cost in a simple way. In fact, many studies have been made to exploit this advantage and applications that have been proposed as a result of such studies include charged particle beam sources and electronic displays. A large number of surface conduction electron-emitting devices can be arranged in an array to form a matrix pattern that operates as an electron source, where the devices of each row are wired in parallel and the rows are regularly arranged to form the array. (See, for example, Japanese Patent Application Laid-Open No. 64-31332 in the name of the same applicant as the present case.)

As for image-forming apparatuses comprising surface conduction electron-emitting devices such as electronic displays, although flat panel displays using a liquid crystal have gained popularity in place of CRT in recent years, such displays are not without problems. One of the problems is that a light source is needed because those displays are not of emission type. An emission type display can be realized using an electron source formed by arranging a large number of surface conduction electron-emitting devices in combination with a fluorescent body that is induced to selectively shed visible light by electrons emitted from the electron source. With such an arrangement, an emission type display apparatus having a large display screen and enhanced display capabilities can be manufactured relatively easily at low cost. See, for example, the U.S. Pat. No. 5,066,883 by the same applicant as the present case.

Incidentally, Japanese Patent Application Laid-Open Nos. 1-283749, 1-257552 and 64-31332 disclose different but similar electron sources that can be used for an image-forming apparatus comprising a plurality of electron-emitting devices. In those electron sources, the plurality of electron-emitting devices are arranged to form a matrix, where the electron-emitting devices of each row are connected in parallel by common wires while control electrodes (grids) are disposed perpendicular to the common wires in a space between the electron source and the fluorescent body so that any of the devices may be selected by applying selectively an appropriate drive signal to the common wires as rows and the control electrodes as columns of the matrix. FIG. 32 of the accompanying drawings schematically shows a plan view of part of an electron source of the type under consideration comprising a plurality of surface conduction electron-emitting devices. Referring to FIG. 32, a plurality of electron-emitting devices 320 are arranged on a substrate and the devices of each row are connected in parallel by a pair of common wires, e.g. common wires 321 and 322, and a grid GR having a number of electron passing holes Gh is arranged for each column of devices perpendicularly to the common wires 321, 322 and above the electron-emitting devices 320 on the substrate.

However, an image-forming apparatus comprising an electron source composed of a plurality of surface conduction electron-emitting devices and a fluorescent body disposed as opposing the electron source is not without problems. Though the surface conduction electron-emitting devices in such an apparatus can be selected and the selected devices can be controlled for electron emission with an image-forming apparatus of the above identified type, this apparatus is not simple. In other words, grids are indispensably needed and arranged along the columns of devices to select a particular device and cause the fluorescent body to emit light selectively at a controlled brightness.

An image-forming apparatus as described above is therefore accompanied by difficulties that commonly appear in the course of manufacture including the difficulty of aligning surface conduction electron-emitting devices and grids and accurately controlling the distance separating the grids and the surface conduction electron-emitting devices. In an attempt to bypass these difficulties, the inventors of the present patent application have already proposed a novel structure wherein grids are laminated on the surface conduction electron-emitting devices. (See Japanese Patent Application Laid-Open No. 3-20941.)

In such a structure, however, the process of manufacturing a plurality of known surface conduction electron-emitting devices involves a step of forming device electrodes and electron-emitting regions in addition to the ordinary steps of wiring as well as the step of preparing grids and therefore, the entire process is cumbersome and complicated.

SUMMARY OF THE INVENTION

In view of the above identified problems of known image-forming apparatuses, it is therefore an object of the present invention to provide an electron source comprising a plurality of electron-emitting devices arranged to show a simple configuration so that any of the devices may be selected and controlled for the emission of electrons as well as an image-forming apparatus comprising such an electron source and a fluorescent body arranged ds opposing the electron source such that the latter may be made to emit light selectively at controlled levels of intensity.

It is another object of the present invention to provide an electron source having a simple configuration that allows it to be manufactured with a simplified manufacturing process as well as an image-forming apparatus incorporating such an electron source.

According to a first aspect of the invention, the above objects and other objects are achieved by providing an electron source comprising a substrate, a row-directional wire, a column-directional wire intersecting said row-directional wire, an insulation layer being arranged at the crossing of and between the row-directional wire and the column-directional wire and a conductive film being also arranged at the crossing of and connected to the row-directional wire and the column-directional wire, said conductive film having an electron-emitting region.

According to a second aspect of the invention, the above objects and other objects are achieved by providing an image-forming apparatus comprising an electron source and an image-forming member for forming images when irradiated with electron beams emitted from said electron source according to input signals, characterized in that said electron source comprises a substrate, a row-directional wire, a column-directional wire intersecting said row-directional wire, an insulation layer being arranged at the crossing of and between the row-directional wire and the column directional wire and a conductive film also arranged at the crossing of and connected to the row-directional wire and the column-directional wire, said conductive film having an electron-emitting region.

BRIEF DESCRIPTION OF THE DRAWINGS

FIG. 18 is a block diagram of a first embodiment of the image-forming apparatus according to the invention.

DETAILED DESCRIPTION OF THE PREFERRED EMBODIMENTS

The present invention is intended to fully exploit the electron-emitting capabilities of surface conduction electron-emitting devices to eliminate the use of grids for the electron source of an image-forming apparatus. More specifically, a total of m row (X-direction) wires and a total of n column (Y-direction) wires are arranged to form a matrix and a surface conduction electron-emitting device is provided on each crossing of the wires so that a number of surface conduction electron-emitting devices are disposed also in the form of a matrix to produce an electron source. Any surface conduction electron-emitting devices of the electron source may be selectively activated by applying drive signals thereto by way of appropriate row and column-directional wires to cause them to emit electron beams in a controlled manner. With such an arrangement, the difficulties accompanying the manufacture of an electron source comprising grids as identified earlier are mostly resolved and an electron source having a simple configuration is realized. Since the row and column-directional wires operate as electrodes for the electron-emitting devices, the devices are prepared without the cumbersome step of forming device electrodes for them to greatly simplify the process of manufacturing the electron source. A novel image-forming apparatus is realized by arranging fluorescent bodies vis-a-vis the electron source in such a way that the fluorescent bodies emit light to form images when irradiated with electron beams by the electron source.

Now, the invention will be described in greater detail by referring to the accompanying drawings.

Firstly, a surface conduction electron-emitting device to be used for the purpose of the invention will be described.

Figure 1:
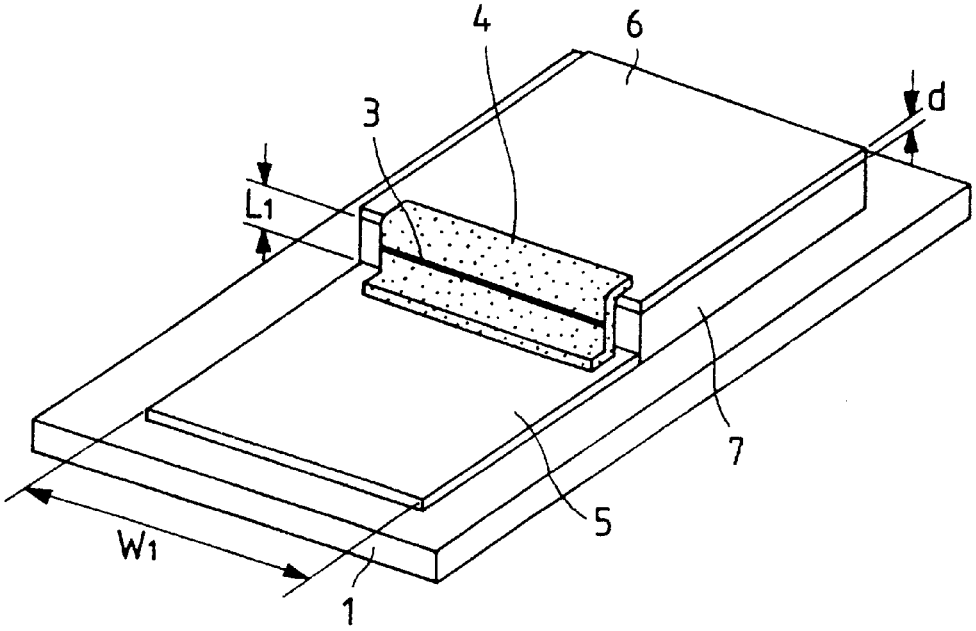
FIG. 1 is a schematic perspective view of a surface conduction electron-emitting device to be used for the purpose of the invention.

FIG. 1 schematically shows a perspective view of a surface conduction electron-emitting device to be used for the purpose of the invention. The device comprises a substrate 1, a electron-emitting region 3, a thin film including the electron-emitting region 4, a pair of device electrodes 5 and 6 and a step section 7. Note that the profile and the position of the electron-emitting region 3 may not necessarily be such as illustrated in FIG. 1. As described later, the device electrodes 5 and 6 correspond to the wires in the present invention, and the step section 7 corresponds to the interlayer insulating layer.

For the purpose of the invention, the substrate 1 is preferably an insulator substrate such as a glass substrate made of quartz glass, glass containing Na and other impurities to a reduced level or soda lime glass, a multilayer glass substrate prepared by forming a $SiO_2$ layer on a piece of soda lime glass by sputtering or a ceramic substrate made of a ceramic material such as alumina. While the oppositely arranged device electrodes 5 and 6 may be made of any conductor material, preferred candidate materials include metals such as Ni, Cr, Au, Mo, W, Pt, Ti, Al, Cu and Pd, their alloys, printable conductor materials made of a metal or a metal oxide selected from Pd, Ag, $RuO_2$ and Pd—Ag and glass, transparent conductor materials such as $In_2O_3$—$SnO_2$ and semiconductor materials such as polysilicon.

Figure 31:
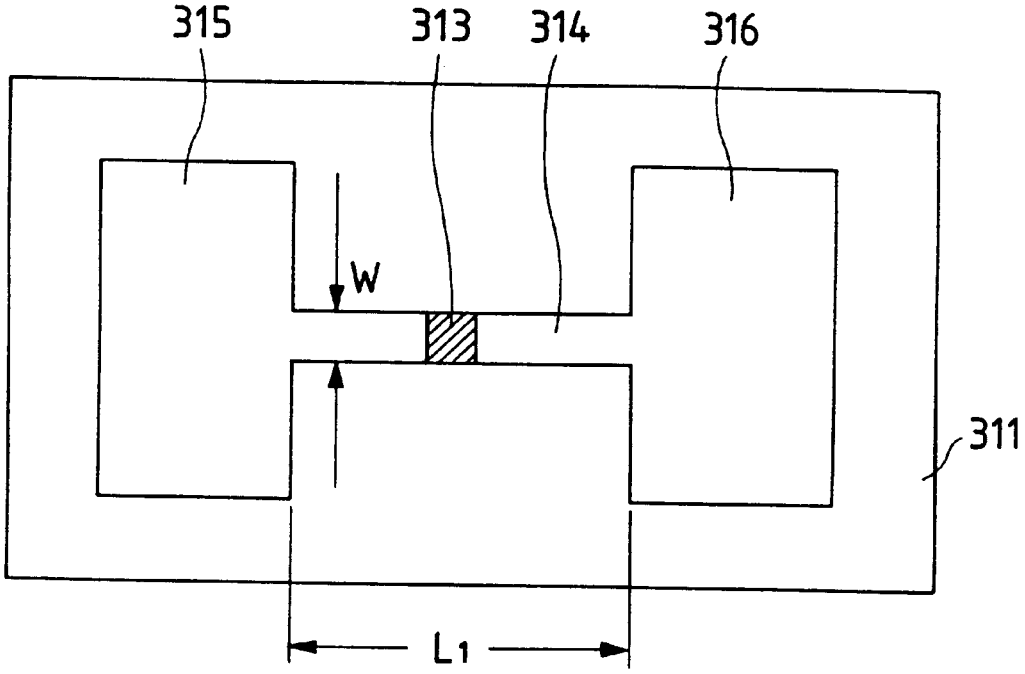
FIG. 31 is a schematic plan view of a conventional flat-type surface conduction electron-emitting device.
Figure 32:
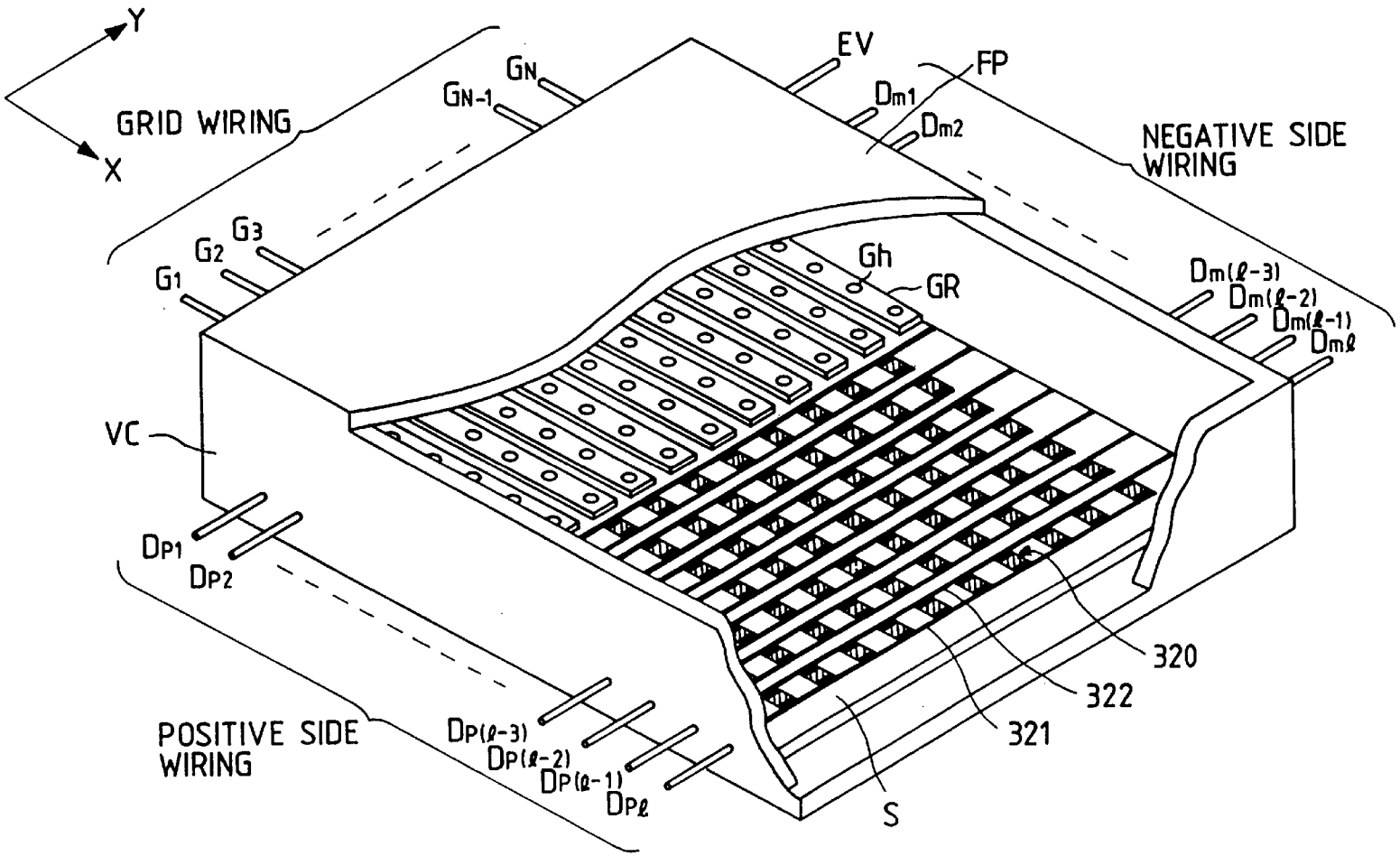
FIG. 32 is a partially cut out schematic perspective view of a conventional image-forming apparatus comprising a plurality of electron-emitting devices.

Incidentally, a surface conduction electron-emitting device as illustrated in FIG. 31 and described earlier is called a plane type device because the pair of device electrodes 315 and 316 are oppositely arranged on a same level and the conductive thin film 314 including an electron-emitting region is formed therebetween. Unlike a plane type device, a surface conduction electron-emitting device to be used for the purpose of the invention comprises a pair of device electrodes 5 and 6 that are arranged on different levels as the device electrode 6 is located on a step section 7 and a conductive thin film 4 including an electron-emitting region that is arranged on a lateral side of the step section 7 such that the thin film 4 is mostly located vertically and perpendicularly relative to the device electrodes 5 and 6. The step section 7 and the thin film 4 including an electron-emitting region will be further described hereinafter.

The step section 7 is made of an insulator material such as $SiO_2$ and produced there by vacuum deposition, printing, sputtering or some other appropriate technique to a thickness between several hundred angstroms and tens of several micrometers, which is substantially equal to the distance L1 separating the device electrodes. Although it is determined as a function of the technique selected for forming the step section, the voltage to be applied to the device electrodes and the electric field strength available for electron emission is preferably found between 1,000 Å and 10 $\mu$m.

The thin film 4 including the electron-emitting region is formed after the device electrodes 5 and 6 and the step section 7 by vacuum deposition, sputtering, chemical vapor deposition, dispersed application, dipping or spinning. It is partly laid on the device electrodes 5 and 6 for electric connection. The thickness of the thin film 4 including the electron-emitting region is between several angstroms and several thousands angstroms, more preferably between ten angstroms and 200 angstroms, and mainly depends on the method of preparing it. Although it is also a function of the stepped coverage of the thin film 4 on the device electrodes 5 and 6, the electric resistance between the electron-emitting region 3 and the device electrodes 5 and 6, and the parameters of the forming operation performed on the electron-emitting region 3 which will be described later and, in many cases, varies on the lateral side of the step section 7 and on the device electrodes 5 and 6. Normally, the thin film 4 is made less thick on the step section than on the electrodes. Consequently, the thin film 4 may be processed by electrically energizing it to produce an electron-emitting region 3 more easily than its counterpart of the plane type surface conduction electron-emitting device described above.

The thin film 4 including an electron-emitting region normally shows an electric resistance per unit surface area between $10^3$ and $10^7$ $\Omega/cm^2$. The thin film 4 including an electron-emitting region is preferably made of fine particles of a material selected from metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, carbon, AgMg, NiCu, Pb and Sn. The term "a fine particle film" as used herein refers to a thin film composed of a large number of fine particles that may be loosely dispersed, tightly arranged or mutually and randomly adjoining or overlapping (to form an island structure under certain conditions).

An electron-emitting region 3 may comprise a number of such fine conductor particles having a particle size between several and several thousands angstroms and preferably between 10 Å and 200 Å and the thickness of the thin film 4 including an electron-emitting region depends on a number of factors including the method selected for manufacturing the device and the parameters for the forming operation that will be described later. The material of the electron-emitting region 3 may be made of all or part of the materials that is used to prepare the thin film 24 including the electron-emitting region.

Figure 2:
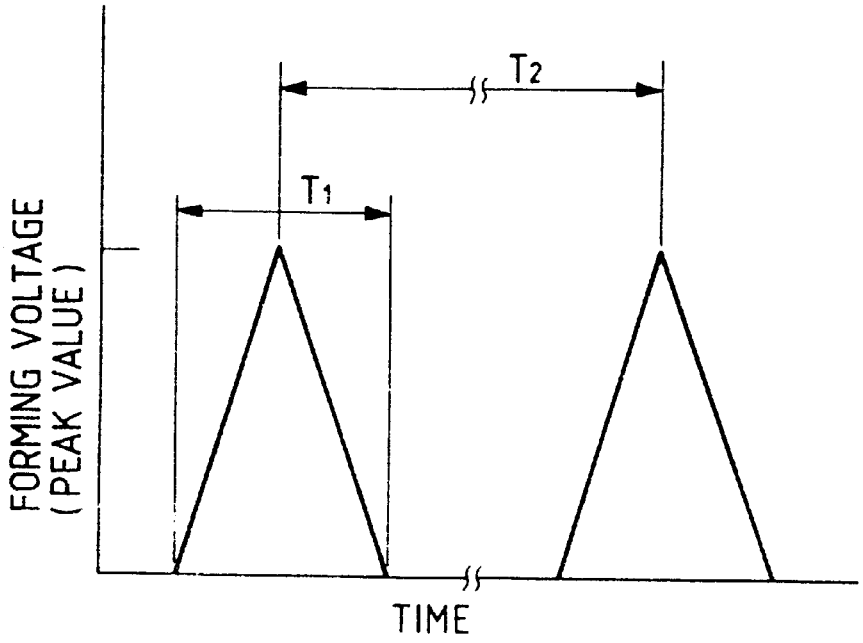
FIG. 2 is a graph showing the waveform of a variable voltage to be used in a forming operation for the purpose of the invention.

Now some of the parameters for the forming operation will be described by referring to FIG. 2 showing the waveform of a variable voltage to be used for the forming operation for the purpose of the invention. In FIG. 2, T1 and T2 respectively indicate the pulse width and the pulse interval of a pulsed voltage having a triangular wave form, T1 being between 1 microsecond and 10 milliseconds, T2 being between 10 microseconds and 100 milliseconds. The forming operation is conducted for a time period between tens of several seconds to tens of several minutes in a vacuum atmosphere with an appropriately selected peak level (peak voltage for the forming operation) for triangular pulse waves. While a voltage is applied to the electrodes of an electron-emitting device in the form of a triangular pulses to produce an electron-emitting region as described above, it may not necessarily take a triangular wave form and rectangular waves or waves in some other form may alternatively be used. Likewise, other appropriate values may be selected for the pulse width, the pulse interval and the peak level to optimize the performance of the electron-emitting region to be produced depending on the intended resistance of the electron-emitting device and other related factors.

Figure 3:
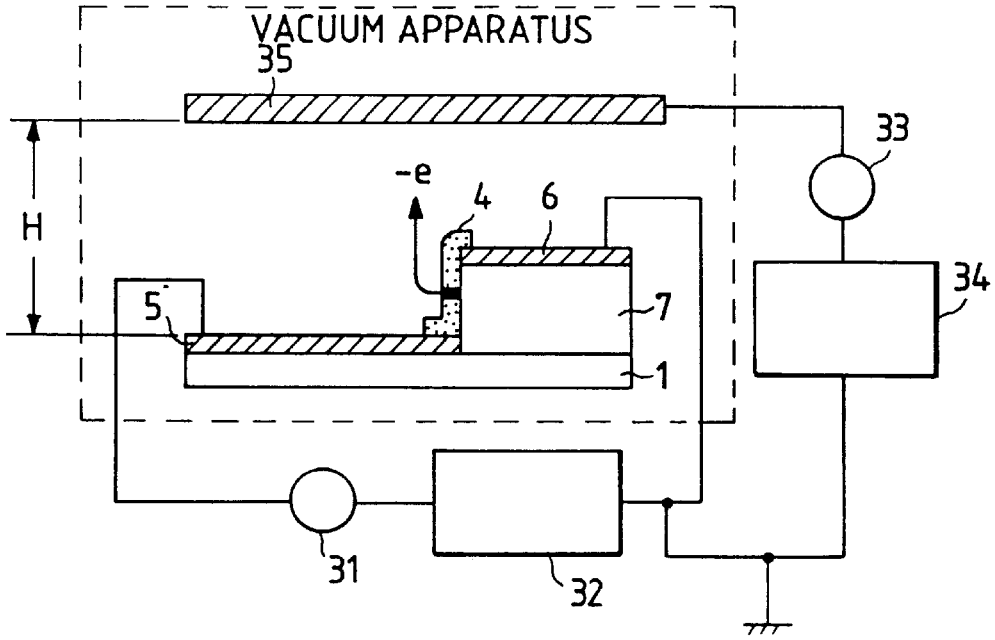
FIG. 3 is a block diagram of measuring system to be used for testing the electron-emitting performance of a surface conduction electron-emitting device.

Now, the performance of an electron-emitting device to be used for the purpose of the invention will be described by referring to FIGS. 3 and 4. FIG. 3 is a schematic block diagram of a measuring system for determining the performance of an electron-emitting device having a configuration as illustrated in FIG. 1. In FIG. 3, reference numerals 1 through 7 denote components of the electron-emitting device shown in FIG. 1. Otherwise, the measuring system comprises an ammeter 31 for measuring the device current If running through the thin film 4 including the electron-emitting section between the device electrodes 5 and 6, a power source 32 for applying a device voltage Vf to the device, another ammeter 33 for measuring the emission current Ie emitted from the electron-emitting region 3 of the device and, a high voltage source 34 for applying a voltage to an anode 35 of the measuring system. For measuring the device current If and the emission current Ie, the device electrodes 5 and 6 are connected to the power source 32 and the ammeter 31 and the anode 35 is placed above the device along the direction of electron emission. The electron-emitting device to be tested and the anode 35 are put into a vacuum chamber, which is provided with an exhaust pump, a vacuum gauge and other pieces of equipment necessary to operate a vacuum chamber so that the measuring operation can be conducted under a desired vacuum condition. For determining the performance of the device, a voltage between 1 and 10 KV is applied to the anode 35, which is spaced apart from the electron-emitting device by distance H which is between 2 and 8 mm.

Figure 4:
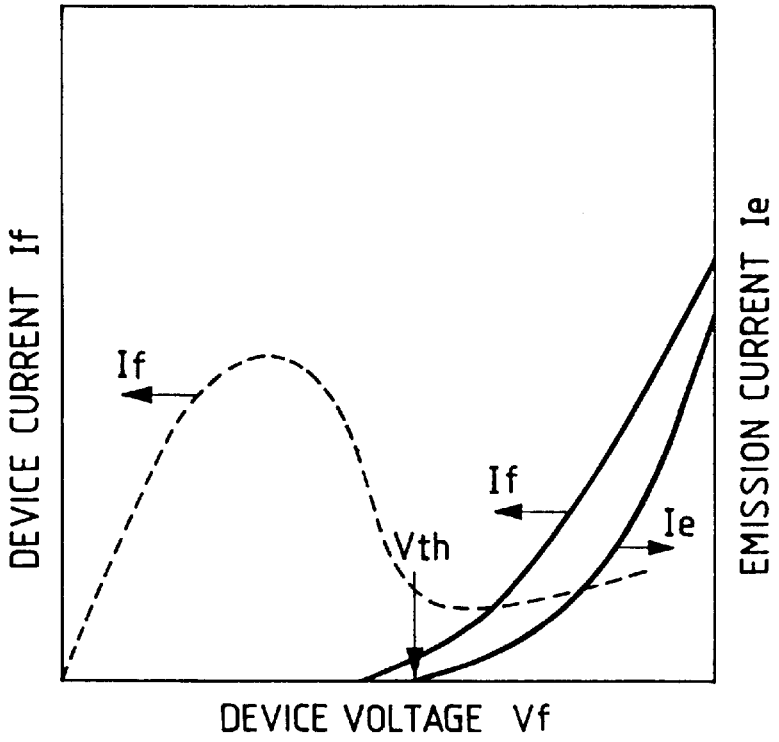
FIG. 4 is a graph showing the electro-emitting performance of a surface conduction electron-emitting device obtained by using the measuring system of FIG. 3.

FIG. 4 shows a graph schematically illustrating the relationship between the device voltage Vf and the emission current Ie and the device current If typically observed by using the above described measuring system. Note that different units are arbitrarily selected for Ie and If in FIG. 4 in view of the fact that Ie has a magnitude by far smaller than that of If. As seen in FIG. 4, an electron-emitting device to be suitably used for the purpose of the invention has three remarkable features in terms of emission current Ie, which will be described below.

Firstly, an electron-emitting device of the type under consideration shows a sudden and sharp increase in the emission current Ie when the voltage applied thereto exceeds a certain level (which is referred to as a threshold voltage hereinafter and indicated by Vth in FIG. 4), whereas the emission current Ie is practically unobservable when the applied voltage is found lower than the threshold value Vth. Differently stated, an electron-emitting device of the above identified type is a non-linear device having a clear threshold voltage Vth to the emission current Ie. Secondly, since the emission current Ie is highly dependent on the device voltage Vf, the former can be effectively controlled by way of the latter. Thirdly, the emitted electric charge captured by the anode 35 is a function of the duration of time of applying the device voltage Vf. In other words, the amount of electric charge captured by the anode 35 can be effectively controlled by way of the time during which the device voltage Vf is applied. Because of the above described remarkable features of a surface conduction electron-emitting device of the above identified type, it may find a variety of applications in various technological fields.

On the other hand, the device current If increases monotonously like the emission current Ie relative to the device voltage Vf (as indicated by the solid line in FIG. 4); but in other cases, the device current If may show a voltage-controlled negative resistance characteristic (hereinafter referred to as VCNR characteristic) relative to the device voltage Vf (as indicated by a broken line in FIG. 4). An electron-emitting device of the type under consideration shows the above described three features when the device current and the device voltage has such a relationship.

Now, an electron source according to the invention will be described. An electron source according to the invention comprises a plurality of surface conduction electron-emitting devices of the above described type arranged on a substrate. As described above, the electrons emitted by an electron-emitting device can be controlled by way of the amplitude and the pulse width of a pulsed voltage to be applied to the device if the voltage exceeds a threshold level. On the other hand, the device does not substantially emit electrons when the voltage is below the threshold level. Therefore, in an electron source comprising a plurality of electron-emitting devices, each device can be controlled for electron emission by utilizing this property of the device and controlling the pulsed voltage to be applied to it. An electron source according to the invention is realized on the basis of this finding.

Figure 5A:
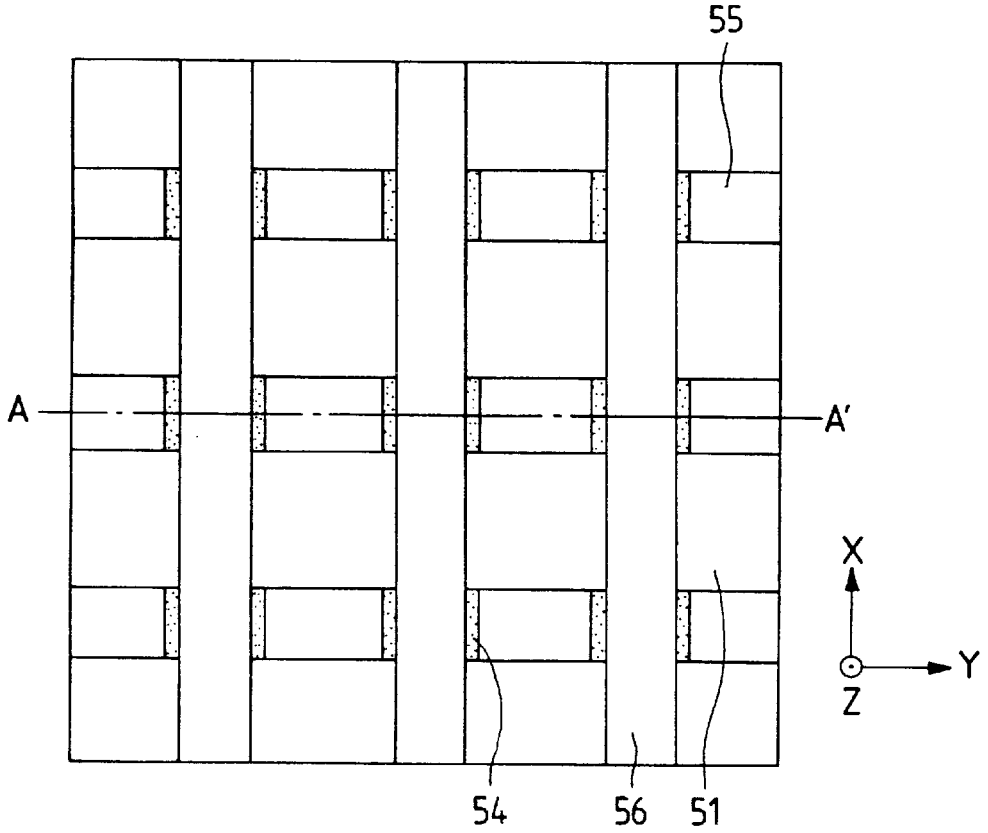
FIGS. 5A and 5B schematically illustrate an embodiment of the electron source with an image-forming screen according to the invention and FIG. 5C illustrates a typical shape of a luminous spot formed by one electron-emitting region.
Figure 5B:
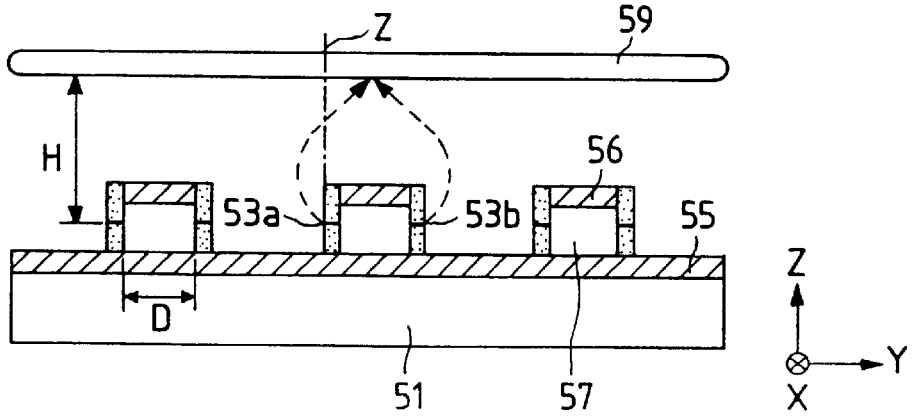

Referring to FIGS. 5A and 5B schematically illustrating an embodiment of electron source according to the invention and realized on the basis of the above described finding as well as an image-forming member to be used with the electron source, the embodiment comprises an insulator substrate 51, X-directional wires 56, Y-directional wires 55 and thin films 54 each including an electron-emitting region.

The substrate 51 is a insulator substrate such as a glass substrate as described earlier and its dimensions are determined as a function of the number of devices arranged on the substrate 1, the designed form of each device and, if it constitutes part of a vacuum container for the electron source, the vacuum conditions of the container as well as other factors. The Y-directional wires 55 are made of a conductive metal and formed on the insulator substrate 51 to show a given pattern by means of an appropriate technique such as vapor deposition, printing or sputtering. The material, the thickness and the width of the Y-directional wires 55 are so selected that a voltage may be evenly applied to the surface conduction electron-emitting devices. Like the Y-directional wires 55, the X-directional wires 56 are also made of a conductive metal and formed on the insulator substrate 51 to show a given pattern by means of an appropriate technique such as vapor deposition, printing or sputtering. The material, the thickness and the width of the Y-directional wires 56 are so selected that a voltage may be evenly applied to the surface conduction electron-emitting devices. An interlayer insulation layer 57 is disposed between an X-directional wire 56 and a Y-directional wire 55 at each crossing thereof to electrically insulate them. The X-directional wires 56 and the Y-directional wires 55 present a matrix of wires.

The interlayer insulation layers 57 are made of $SiO_2$ etc. and formed on part of the insulator substrate 51 that carries the Y-directional wires 55 thereof by means of an appropriate technique such as vapor deposition, printing or sputtering to show a desired profile. The film thickness, the material and the manufacturing method are so selected as to make them withstand the largest possible potential difference at the crossings of the X- and Y-directional wires. Each of the X- and Y-directional wires is extended to provide an external terminal.

Note that, for the purpose of the present invention, each of the interlayer insulation layers 57 takes the role of the step section 7 of a surface conduction electron-emitting device as illustrated in FIG. 1.

Either a same conductor material or totally or partly different conductor materials may be used for the X-directional wire 56 and the Y-directional wire 55. Such materials may be appropriately selected from metals such as Ni, Cr, Au, Mo, W, Pt, Ti, Al, Cu and Pd, alloys of these metals, printing conductor materials constituted of a metal or a metal oxide such as Pd, Au, $RuO_2$, Pd—Ag and glass and semiconductor materials such as polysilicon.

While surface conduction electron-emitting devices having a configuration as described earlier are used for an electron source according to the invention, it should be noted that the row-directional wires and the column-directional wires that intersect each other with insulation layers interposed therebetween operate as device electrodes for the electron-emitting devices. The electron-emitting region of each electron-emitting device may be formed at any location or near a crossing of a row-directional wire and a column-directional wire so far as the wires can operate as device electrodes for the electron-emitting device. More specifically, the insulation layer of the crossing is partly removed to expose the lower wire at least at and near the crossing and a thin film including an electron-emitting region is formed on a lateral side of the insulation layer. Thus, the insulation layer takes the role of the step section 7 of the electron-emitting device of FIG. 1. The lateral side of the insulation film on which the electron-emitting region is formed may have any profile and, therefore, it may be perpendicular to any angle relative to the straight wires. Alternatively, it may show a stepped or curved profile. When an electron-emitting region is formed in the vicinity of the crossing, the lateral side of the insulation layer may be jagged or curved along the wires in order to make the electron-emitting region longer than the length of the corresponding area that surround the crossing so that it may emit electrons at an enhanced amount in a well controlled manner to improve the performance of the electron source.

When an image-forming apparatus according to the invention is so designed that a plurality of electron beams emitted from electron-emitting devices arranged at wire crossings are converged on an image-forming screen, it is preferable that a pair of electron-emitting devices are symmetrically arranged at opposite sides of each wire crossing.

Since the wires arranged in the form of a matrix in an electron source according to the invention are used for device electrodes, the wires need to meet the requirements normally imposed on device electrodes. Thus, for the purpose of the invention, the materials and the method for preparing a surface conduction electron-emitting device need to be selected from the above described candidates so that they also meet those requirements in terms of steps and materials for manufacturing an electron-emitting region, the thickness of the insulation layer and the widths of the row- and column-directional wires, although the width of the wires may be demanded to meet rigorous requirements as will be described later.

Electron beams emitted from more than one of the electron-emitting regions of an electron source according to the invention can be converged to a selected spot on the image-forming screen of the image-forming apparatus comprising the electron source to modify the brightness and the form of the spot under a controlled manner depending on the distribution of brightness of the image-forming screen. In order for an image-forming screen to produce a clear image, the screen should be irradiated with electron beams at an enhanced intensity. For the purpose of the invention, a desired intensity of electron beam irradiation can be achieved for a selected spot of the screen by converging electron beams emitted from more than one electron-emitting devices. In other words, the electron-emitting devices of an electron source according to the invention is advantageous in that it can realize an enhanced intensity of electron beam irradiation on an image-forming screen even if the rate of electron beam emission of a single surface conduction electron-emitting device is low. At the same time, each bright spot produced by electron beams on the image-forming screen may change its form in a controlled manner by controlling the operation of converging electron beams.

FIGS. 5A and 5B schematically illustrate an embodiment of electron source according to the invention. In this embodiment, an electron-emitting device is formed in the vicinity of each wire crossing. FIG. 5A is a plan view of the embodiment and FIG. 5B is a sectional view taken along line A–A' in FIG. 5A. Referring to FIGS. 5A and 5B, the embodiment comprises an insulator substrate 51, thin films 54 each having an electron-emitting region, Y-directional wires 55, X-directional wires 56 and insulation layers 57. While a thin film 54 is fitted to a lateral side of each insulation layer 57 in this embodiment mainly for the purpose of simplicity of illustration, the thin film 54 may be extended onto the related X-directional wire 56 or Y-directional wire 55 or both in order to improve the electrical connection therewith.

Now, the technique by which electron beams from more than one electron-emitting devices are converged on an image-forming screen for the purpose of the invention will be described by referring to FIG. 5B. In FIG. 5B, the broken lines indicate the traces of electron beams emitted from a pair of electron-emitting regions 53*a* and 53*b*. In this embodiment, drive voltages are applied to the X-directional wire 56 and the Y-directional wire 55 in such a way that the former shows an electric potential higher than that of the latter so that electron beams may be effectively emitted toward an image-forming screen 59. Electron beams are emitted from a pair of electron-emitting regions arranged at opposite sides of a wire crossing and accelerated by an accelerating voltage (not shown) applied to the image-forming screen 59 to hit the screen 59. As the electric field formed by the drive voltages applied to the wires are affected by the accelerated voltage, the electron beams are also deflected toward the higher potential electrode. In FIG. 5B, the electron beam from the electron-emitting region 53*a* is accelerated by the accelerating voltage of the image-forming screen 59 in the Z-direction and, at the same time, it is also accelerated in the Y-direction by the drive voltages applied to the wires of that crossing so that consequently it traces a track as indicated by a broken line before it strikes the image-forming screen 59. Similarly, the electron beam from the electron-emitting region 53*b* is accelerated in both the Z- and Y-directions so that it traces a track as indicated by another broken line before it hits the image-forming screen 59. The image-forming apparatus is so designed that the electron beams emitted from the two electron-emitting regions 53*a* and 53*b* are converged to a same spot on the image-forming screen 59. This can be done by appropriately specifying (as described in detail later) the distance D between the two electron-emitting regions arranged at opposite sides of a wire crossing (or the width of a wire in this embodiment), the drive voltages Vf applied to a wire crossing, the accelerating voltage Va applied to the image-forming screen and the distance H between the image-forming screen and the electron source.

Figure 5C:
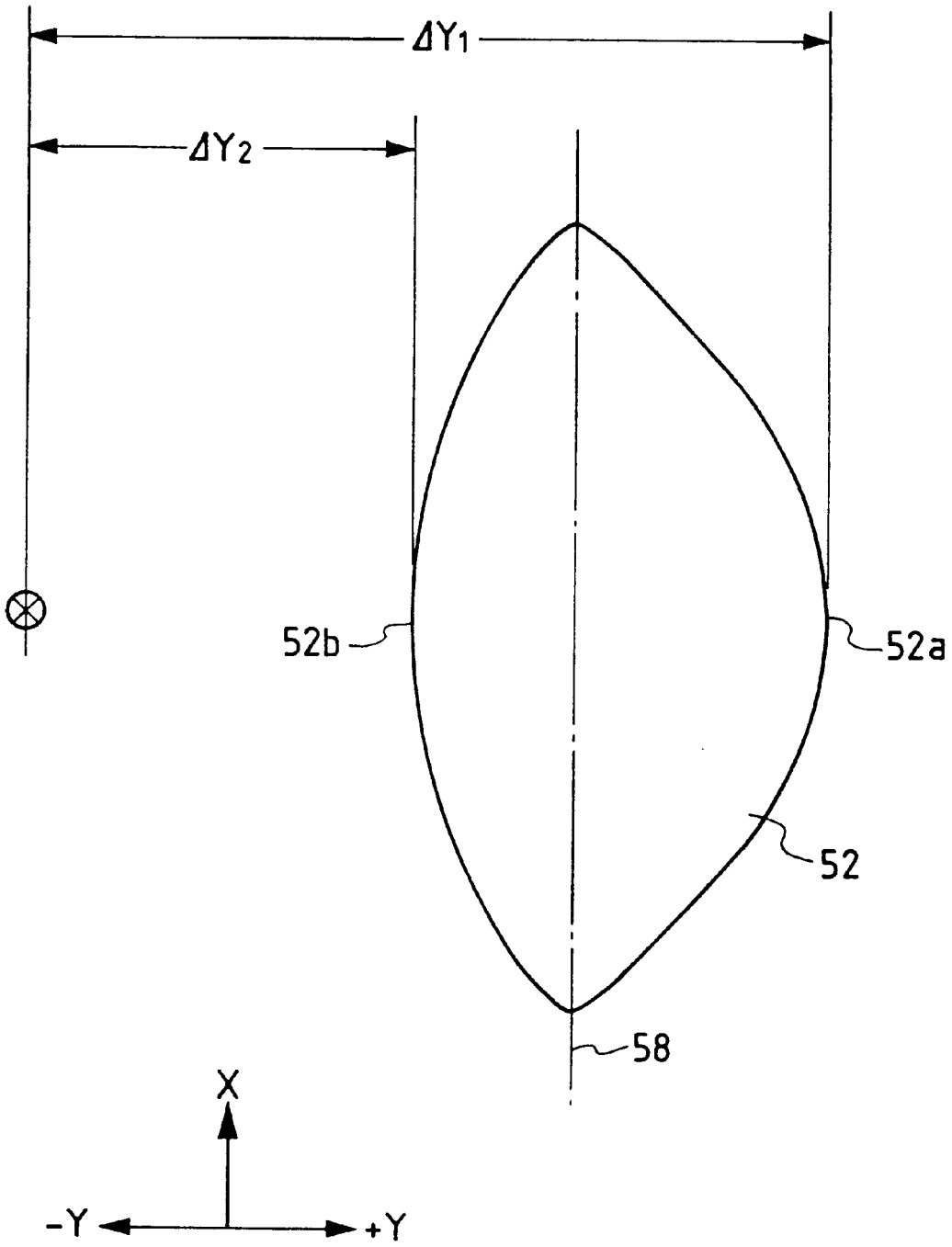

FIG. 5C is a schematic enlarged illustration of a luminous spot 52 of a fluorescent body on an image-forming screen 59 observed by the applicant of the inventors present invention in an apparatus as shown in FIGS. 5A and 5B. Note that FIG. 5C shows only the luminous spot caused to emit light only by the electron-emitting region 53*a* of FIG. 5B.

It was found that, as seen in FIG. 5C, a luminous spot of a fluorescent body is expanded to a certain extent both in the direction of voltage application on the wire crossing (X-direction) and in a direction perpendicular to it (Y-direction). Symbol ⓧ in FIG. 5C indicates the crossing of the broken line Z and the image-forming screen 59 in FIG. 5B.

While the reason why such a luminous spot is formed or an electron beam is expanded to a certain extent before it collides with the image-forming screen is not particularly clear, the inventors of the present invention believe on the basis of a number of experiments that it is possibly because electrons are scattered to a certain extent with a given velocity at the time when they are emitted from the electron-emitting region.

The inventors of the present invention also believe that, of the electrons emitted from the electron-emitting region 53*a* in different directions, those that are directed to the higher potential wire (in positive X-direction) get to the front end 52*a* of the luminous spot and those that are directed to the lower potential wire (in negative Y-direction) arrive at the rear end 52*b* of the luminous spot to produce a certain width along Y-direction. Since that the luminance of the luminous spot is low at the rear end 52*b*, it may be safely assumed that the electrons emitted toward the low potential wire (in negative Y-direction) are very small in number.

It was also found by a number of experiments conducted by the inventors of the present invention that the luminous spot 52 is normally slightly deflected from the vertical axis (or the broken line Z in FIG. 5B) of the electron-emitting region 53*a* into positive Y-direction.

The inventors of the present invention believes this can be explained by that the equipotential lines are not parallel with the surface of the image-forming screen 59 near the electron-emitting region 53*a* and therefore electrons emitted from there and accelerated by the accelerating voltage Va fly away not only in the Z-direction in FIG. 5B but also toward the high potential wire (in positive Y-direction).

Differently stated, the electrons emitted from an electron-emitting region 53*a* are inevitably deflected to a certain extent by the voltage Vf applied thereto for acceleration immediately after the emission.

After looking into the size of the luminous spot 52 and the electrons deflected from the vertical axis of the electron-emitting region 53*a* into the Y-direction and other phenomena, the inventors of the present invention came to believe that the deviation of the front end of the luminous spot from the vertical axis of the electron-emitting region 53*a* (ΔY1 in FIG. 5C) and that of the rear end of the luminous spot from the vertical axis of the electron-emitting region 53*a* (ΔY2 in FIG. 5C) can be expressed in terms of Va, Vf and H.

When a target to which voltage Va(V) is applied is located above an electron source (in Z-direction) and separated by distance H and the space between the target and the electron source is filled with an evenly distributed electric field, the displacement in the Y-direction of an electron emitted from the electron source with an initial Y-direction velocity of V (eV) and an initial Z-direction velocity of 0 is expressed by equation (A) below which is derived from the equation of motion.

$$\Delta Y = 2H\sqrt{\frac{V}{Va}} \tag{1}$$

Since it was discovered in a series of experiments conducted by the inventors of the present invention that, while the electric field is swerved near the electron-emitting region by the voltage applied to the wires and therefore electrons are accelerated also in the Y-direction, the voltage applied to the image-forming screen is sufficiently greater than the voltage normally applied to the electron-emitting device and consequently the emitted electrons are accelerated in the Y-direction only near the electron-emitting region and thereafter move in that direction at a substantially constant speed. Thus, the deviation in the Y-direction of an electron can be obtained by replacing V in equation (1) with a formula for expressing the Y-directional velocity of the electron after it has been accelerated near the electron-emitting region (or near the higher potential wire to state more concisely).

If the X-directional velocity component of an electron is C (eV) after it has been accelerated in the X-direction near the electron-emitting region, C is a parameter to be modified by voltage Vf applied to the device. Thus, if C is expressed as a function of Vf, or C(Vf) (unit being (eV), and the latter is used for equation (A), equation (2) below can be obtained for displacement ΔY0.

$$\Delta Y0=2H\sqrt{(C(Vf)/Va)} \quad (2)$$

Equation (2) above expresses the displacement of an electron that is emitted from the electron-emitting region with an initial Y-directional velocity of 0 and given a Y-direction velocity of C (eV) near the electron-emitting region under the influence of voltage Vf applied to the device electrodes.

In reality, the initial velocity of the electron has various directional components including the Y-directional component. If the initial velocity has a quantity of v0 (eV), from equation (1) the largest and smallest displacements of an electron beam in the Y-direction will be expressed by equations (3) and (4) below respectively.

$$\Delta Y1=2H\sqrt{(C+v0)/Va)} \quad (3)$$

$$\Delta Y2=2H\sqrt{(C-v0)/Va)} \quad (4)$$

Since v0 can also be assumed to be a parameter whose value changes depending on voltage Vf applied to the electron-emitting region and both C and v0 are functions of Vf, the following equations containing constants K2 and K3 can be obtained.

$\sqrt{(C+v0)}=K2\sqrt{Vf}$ and $\sqrt{(C-v0)}=K3\sqrt{Vf}$

By modifying equations (3) and (4) and using the above formulas, equations (5) and (6) below can be produced.

$$\Delta Y1=K2\times 2H\sqrt{(Vf/Va)} \quad (5)$$

$$\Delta Y2=K3\times 2H\sqrt{(Vf/Va)} \quad (6)$$

where H, Vf and Va are measurable quantities and so are ΔY1 and ΔY2.

As a result of a number of experiments where the quantities of ΔY1 and ΔY2 are observed as shown in FIG. 5C, varying the values of H, Vf and Va, the inventors of the present invention obtained the following values for K2 and K3.

K2=1.25+0.05 and

K3=0.35+0.05.

The above values hold particularly true when accelerating electric field strength (Va/H) is not lower than 1 kV/mm.

From the above empirical achievements, the quantity (S1) of the rveltage applied (in Y-direction) to an electron in the electron beam spot on the image-forming screen is expressed by a simple formula as shown below.

$$S1=\Delta Y1-\Delta Y2.$$

If K1=K2−K3, then equation (7) below is obtained from equations (5) and (6) above.

$$S1=K1\times 2H\sqrt{(Vf/Va)} \quad (7)$$

where $0.8 \leqq K1 \leqq 1.0$.

On the basis of the above equations, the inventors of the present invention went on the study of the behavior of electron beams emitted from a number of electron-emitting regions on the image-forming screen.

In the embodiment illustrated in FIGS. 5A and 5B, emitted electrons get to the image-forming screen to form an asymmetrical pattern there under the influence of a swerved electric field in the vicinity of the electron-emitting region and the edges of the electrodes as typically shown in FIG. 5C.

This phenomenon of a deformed luminous spot and an asymmetrical spot can give rise to a problem of degraded image resolution to such an extent that can render characters, if displayed, practically illegible and severely blur any moving images.

The contour of a luminous spot illustrated in FIG. 5C is asymmetrical relative to Y-axis and the amount with which its front or rear end is displaced from the axis perpendicular to the electron-emitting region can be obtained by using equation (5) or (6) respectively. The inventors of the present invention discovered that a highly symmetrical luminous spot can be achieved when a plurality of electron-emitting regions are arranged with a distance D defined by equation (13) below for separating adjacent sections along the direction of voltage application and made to hit a same spot on the image-forming screen.

$$K2\times 2H\sqrt{(Vf/Va)} \geqq D/2 \geqq K3\times 2H\sqrt{(Vf/Va)} \quad (13)$$

where K1 and K2 are constant and K2=1.25+0.05 and K3=0.35+0.05.

In another embodiment of electron source according to the invention, surface conduction electron-emitting devices having a configuration as described earlier are also used along with a matrix of row-directional wires (row wires) and column-directional wires (column wires) intersecting each other with an insulation layer disposed at each of the crossings to separate the crossing two wires, which operates as device electrodes for the electron-emitting device at that crossing, and a thin film including an electron-emitting region is formed on opposite sides of each of the insulation layers as in the case of the embodiment of FIGS. 5A and 5B. However, different from the above embodiment, it is additionally provided with auxiliary electrodes formed by partly removing the upper wires on the insulation layers at the wire crossings to produce holes that reach the respective lower wires of the crossings. Alternatively, an electron-emitting region may be formed in each hole of the upper wire at each wire crossing and an auxiliary electrode may be prepared by extending the lower wire along the insulation layer. With such provision of auxiliary electrodes in this embodiment, the tracks of electron beams emitted from the electron emitting regions can be better controlled.

Since the wires arranged in the form of a matrix in an electron source according to the invention are used for device electrodes, the wires need to meet the requirements normally imposed on device electrodes. Thus, for the purpose of the invention, the materials and the method for preparing a surface conduction electron-emitting device need to be selected from the above described candidates so that they also meet those requirements in terms of steps and materials for manufacturing an electron-emitting region, the thickness of the insulation layer and the widths of the row- and column-directional wires, although the width of the wires may be demanded to meet rigorous requirements.

Figure 6A:
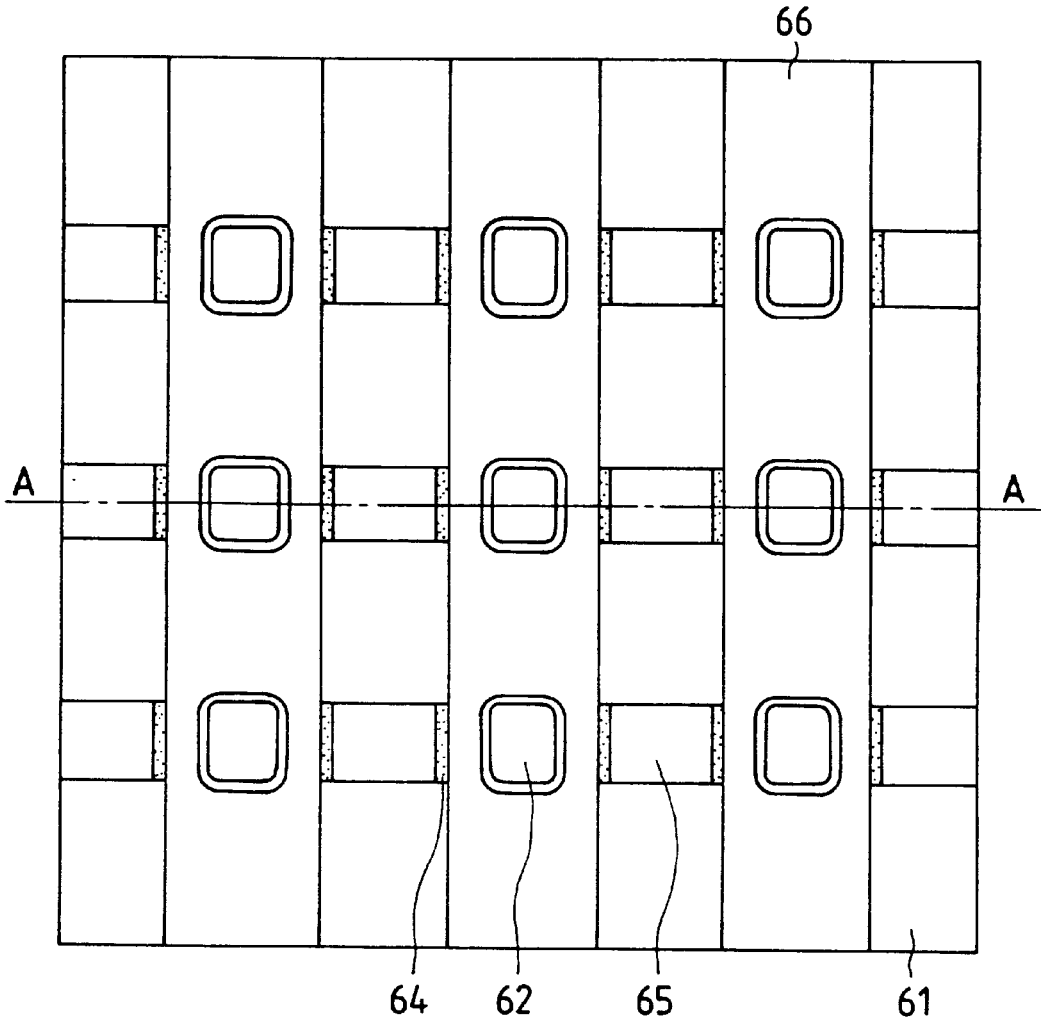
FIGS. 6A and 6B schematically illustrate another embodiment of the electron source additionally comprising auxiliary electrodes according to the invention.
Figure 6B:
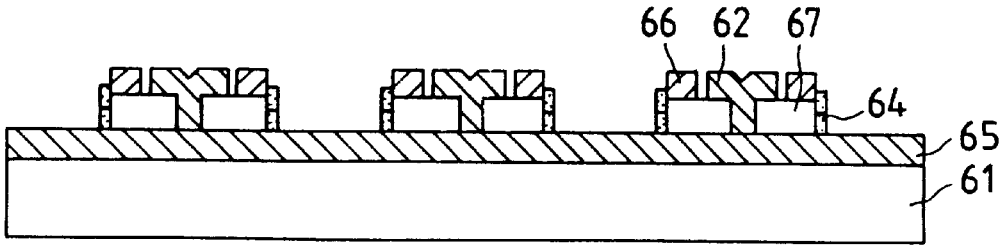

FIGS. 6A and 6B schematically show the above described embodiment provided with auxiliary electrodes. As in the case of the first embodiment, holes are bored through the top of the wire crossings until they reach the respective lower wires of the crossings and auxiliary electrodes are prepared by extending the lower wires. FIG. 6A is a plan view of the embodiment, whereas FIG. 6B is a cross sectional view taken along line A–A' of FIG. 6A. The embodiment comprises an insulator substrate 61, auxiliary electrodes 62, thin films 64 each including an electron-emitting region, Y-directional wires 65, X-directional wires 66 and insulation layers 67. While a thin film 64 is fitted to a lateral side of each insulation layer 67 in FIGS. 6A and 6B mainly for the purpose of simplicity of illustration, the thin film 64 may be extended onto the related X-directional wire 66 or Y-directional wire 65 or both in order to improve the contact therewith.

Still another embodiment of electron source according to the invention is characterized in that the thickness of the insulation layer at each wire crossing is made greater than the distance between the row-directional wire and the column-directional wire of the electron-emitting region at that wire crossing. An electron source according to the invention is accompanied by the problem that the insulation layer provided at each wire crossing may show a relatively large capacitance that prevents a high speed drive of the electron-emitting device arranged there and, therefore, this embodiment is designed to resolve that problem by increasing the thickness of the insulation layer. More generally, the capacitance of the insulation layer is reduced to improve the driving capability without changing the distance between the device electrodes by modifying the profiles of the wires or by forming a recess on a corresponding area of the substrate and bending the lower electrode along the recess to allow an insulation layer having an increased thickness to be arranged there.

On the basis of the above described engineering concept underlying the above embodiment, an electron source with a different electron-emitting behavior may be produced by forming electron-emitting devices that are smaller than the distance separating the two wires at the wire crossings if the thickness of the insulation layers remains unchanged.

Figure 7A:
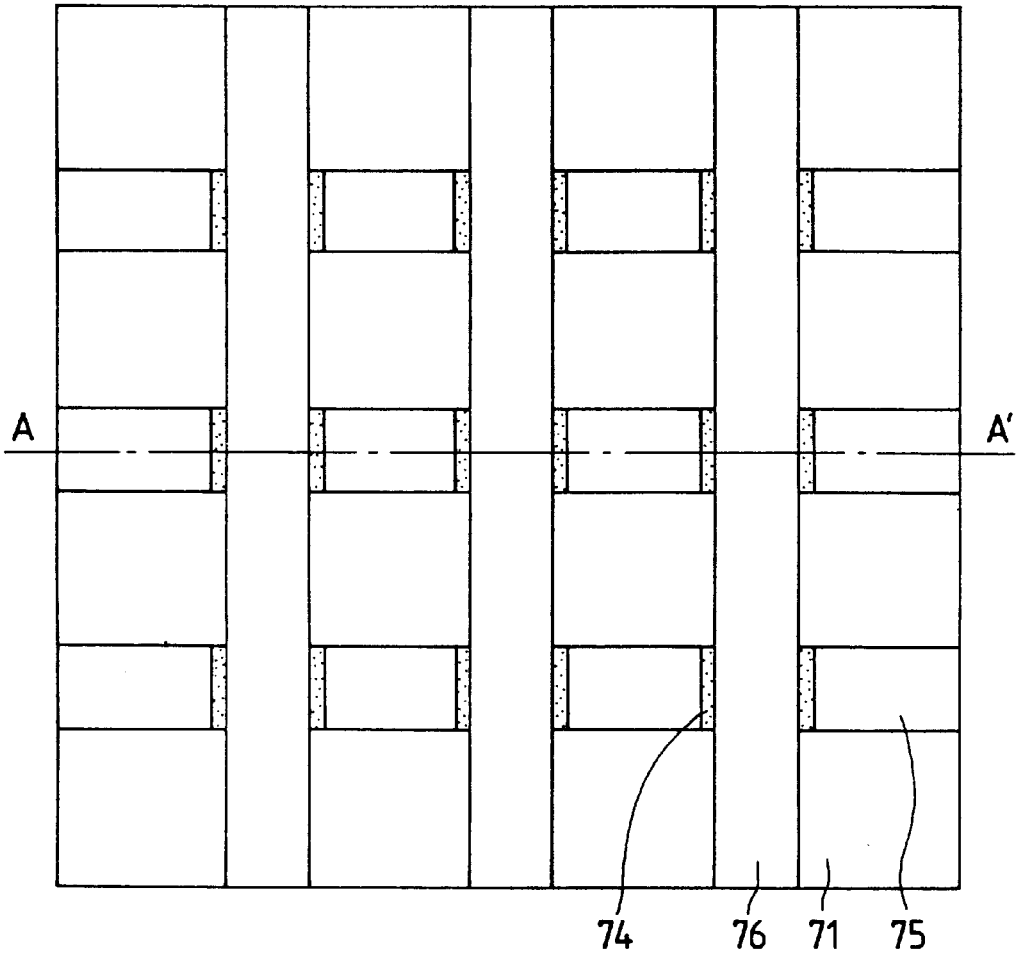
FIGS. 7A and 7B schematically illustrate still another embodiment of electron source according to the invention.
Figure 7B:
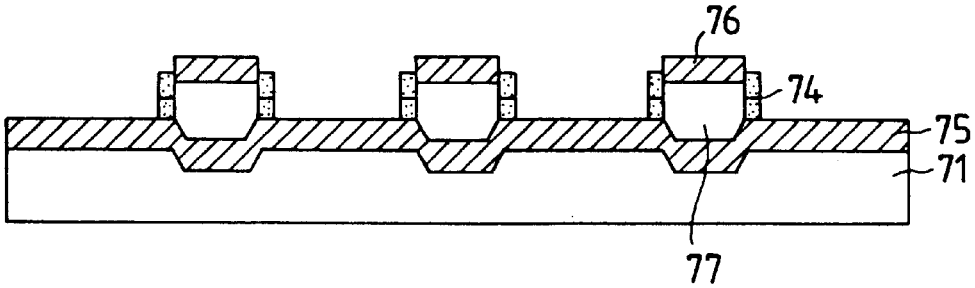

FIGS. 7A and 7B schematically show the above described embodiment provided with insulation layers having a reduced capacitance. In this embodiment, grooves are formed along the X-directional and the Y-directional wires that rectangularly cross the X-directional wires are bent along the grooves to allow insulation layers to have a thickness that is increased by the depth of the grooves from the thickness of their counterparts of the preceding embodiments. FIG. 7A is a plan view of the embodiment, whereas FIG. 7B is a cross sectional view taken along line A–A' of FIG. 7A. The embodiment comprises an insulator substrate 71, thin films 74 each including an electron-emitting region, Y-directional wires 75, X-directional wires 76 and insulation layers 77. While a thin film 74 is fitted to a lateral side of each insulation layer 77 in FIGS. 7A and 7B mainly for the purpose of simplicity of illustration, the thin film 74 may be extended onto the related X-directional wire 76 or Y-directional wire 75 or both in order to improve the contact therewith.

Figure 8:
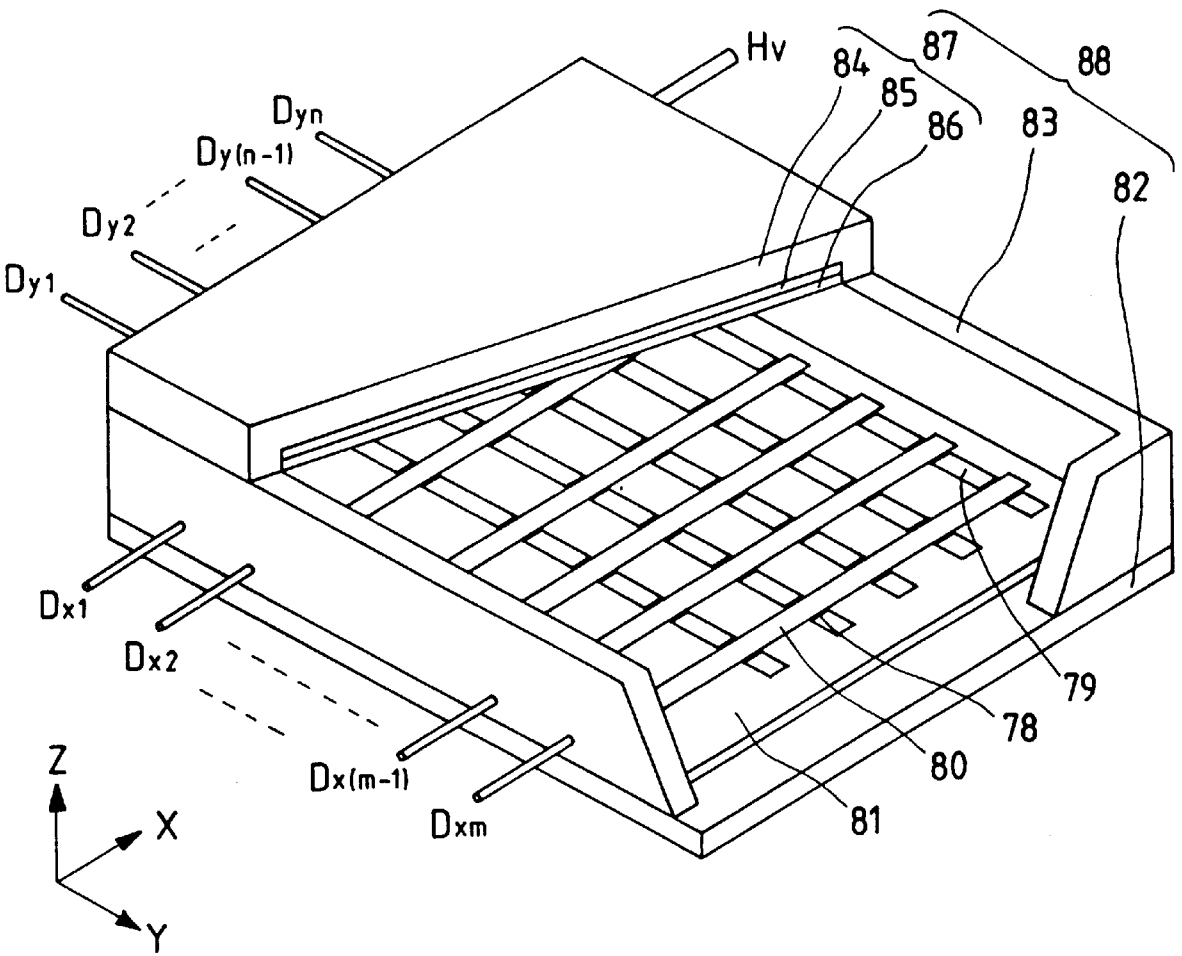
FIG. 8 is a partially cut out schematic perspective view of an embodiment of the image-forming apparatus according to the invention, showing its basic configuration.
Figure 9A:
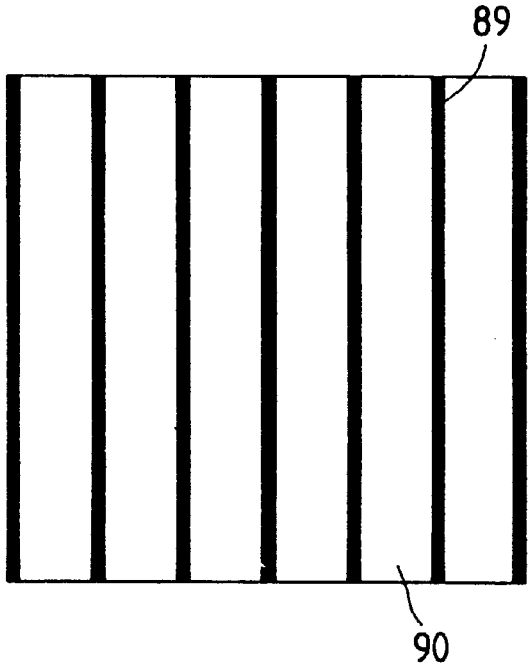
FIGS. 9A and 9B schematically illustrate two possible arrangements of the fluorescent body that can be used for an image-forming apparatus according to the invention.
Figure 9B:
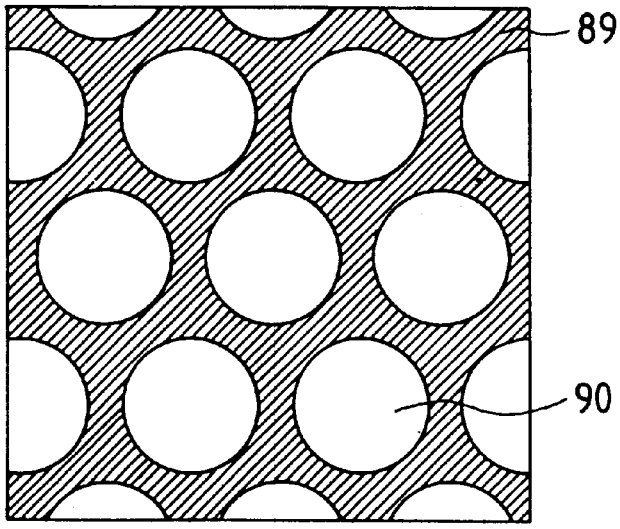

FIG. 8 is a partially cut out schematic perspective view of the display panel of an image-forming apparatus according to the invention, showing its basic configuration. FIGS. 9A and 9B schematically illustrate two possible arrangements of fluorescent bodies to form a fluorescent film. Referring particularly to FIG. 8, the display panel comprises an electron source insulator substrate 81, rear plate 82 for securely holding the electron source insulator substrate 81, a support frame 83, thin films 78 formed on the electron source insulator substrate 81 and each including an electron-emitting region, Y-directional wires 79, X-directional wires 80, and a face plate 87 realized by forming a fluorescent film 85 and a metal back 86 on the inner surface of a glass substrate 84, said rear plate 82, said face plate 87 and said support frame 83 being bonded together and hermetically sealed with frit glass to form a container 88. Of the components of the container 88 comprising the face plate 87, the support frame 83 and the rear plate 82, the rear plate 82 is mainly provided to reinforce the electron source insulator substrate 81 and, therefore, it may be omitted if the electron source insulator substrate 81 has sufficient strength. If such is the case, the electron source insulator substrate 81 is directly bonded to the support frame 83 so that the container 88 is constituted of the face plate 87, the support frame 83 and the electron source insulator substrate 81. The overall strength of the container 88 may be increased by arranging a number of spacers (not shown) between the face plate 87 and the rear plate 82.

FIGS. 9A and 9B schematically illustrate two possible arrangements of fluorescent bodies to form a fluorescent film 85. While the fluorescent film 85 comprises only fluorescent bodies if the display panel is used for showing black and white pictures, it needs to comprise for displaying color pictures fluorescent bodies 90 and black conductive members 89 normally referred to as black stripes or members of a black matrix depending on the arrangement of the fluorescent bodies. Black stripes are or a black matrix is arranged for a color display panel so that the fluorescent bodies 90 of three different primary colors are made less discriminable and the adverse effect of reducing the contrast of displayed images of external light is weakened by blackening the surrounding areas. While graphite is normally used for the black conductive members 89, other conductive material having low light transmissivity and reflectivity may alternatively be used. A precipitation or printing technique is suitably used for applying a fluorescent material on the glass substrate 84 regardless of black and white or color display.

An ordinary metal back 86 is arranged on the inner surface of the fluorescent film 85. The metal back 86 is provided in order to enhance the luminance of the display panel by causing the rays of light emitted from the fluorescent bodies and directed to the inside of the container 88 to turn back toward the face plate 87, to use it as an electrode for applying an accelerating voltage to electron beams and to protect the fluorescent bodies against damage that may be caused when negative ions generated inside the container collide with them. It is prepared by smoothing the inner surface of the fluorescent film 85 (in an operation normally called "filming") and forming an Al film thereon by vacuum deposition after preparing the fluorescent film 85. A transparent electrode (not shown) may be formed on the face plate 87 facing the outer surface of the fluorescent film 85 in order to raise the conductivity of the fluorescent film 85.

Care should be taken to accurately align each set of color fluorescent bodies and an electron-emitting device, if a color display is involved, before the above listed components of the container are bonded together.

The container 88 is then evacuated by way of exhaust pipe (not shown) to a degree of vacuum of approximately $10^{-6}$ and hermetically sealed. Then, a voltage is applied to the X-directional wires 80 and the Y-directional wires 79 by way of external terminals Dx1 through Dxm and Dy1 through Dyn to carry out a forming operation in order to produce an electron-emitting region. A getter operation may be carried out after sealing the container 88 in order to maintain that degree of vacuum. A getter operation is an operation of heating a getter (not shown) arranged at a given location in the container 88 immediately before or after sealing the container 88 by high frequency heating to produce a vapor deposition film. A getter normally contains Ba as a principle ingredient and the formed vapor deposition film can typically maintain the inside of the container to a degree of $1\times10^{-5}$ to $10^{-7}$ Torr by its adsorption effect.

An image-forming apparatus according to the invention and having a configuration as described above is operated by applying a voltage to each electron-emitting device by way of the external terminals Dx1 through Dxm and Dy1 through Dyn to cause the electron-emitting devices to emit electrons. Meanwhile, a high voltage greater than several kV is applied to the metal back 85 or the transparent electrode (not shown) by way of high voltage terminals Hv to accelerate electron beams and cause them to collide with the fluorescent film 85, which by turn is energized to emit light to display intended images.

While the configuration of a display panel to be suitably used for an image-forming apparatus according to the invention is outlined above in terms of indispensable components thereof, the materials of the components are not limited to those described above and other materials may appropriately be used depending on the application of the apparatus.

It should also be noted that an electron source according to the invention may be suitably used not only for an image-forming apparatus but also as a replacement of a light source of an optical printer comprising a photosensitive drum and light emitting diodes. If such is the case, it may be used not only as a linear light source but also as a two-dimensional light source when it is so arranged that the m X-directional wires and the n Y-directional wires may be appropriately selected and combined used.

Embodiment 1

Figure 10A:
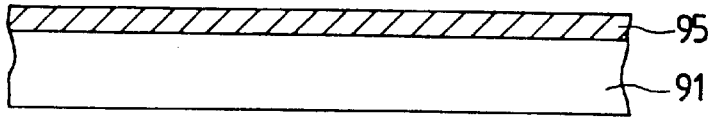
FIGS. 10A through 10F schematically illustrate different steps of manufacturing the electron source according to the invention.

An embodiment of electron source having a configuration as shown in FIGS. 5A and 5B is preferred by the way of the manufacturing steps as described below by referring to FIGS. 10A and 10B.

(1) After thoroughly cleaning a quartz substrate 91 by means of an organic solvent, a 50 Å thick Cr layer and a 6,000 Å thick Au layer are sequentially formed by vacuum deposition. Thereafter, photoresist (AZ 1370 available from HECHST) is applied thereto while turning the substrate by a spinner and then the applied photoresist is baked. Then, the photoresist layer is exposed to light through a photomask and photochemically developed to produce a resist pattern for Y-directional wires 95. Subsequently, the Au and Cr deposit layers are wet etched to produce Y-directional wires 95 (FIG. 10A).

Figure 10B:
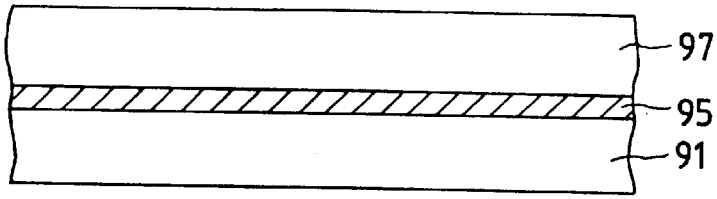

(2) An insulation layer 97 may of $SiO_2$ is formed to a thickness of 1 $\mu$m on the entire surface of all the Y-directional wires 95 by CVD (FIG. 10B).

Figure 10C:
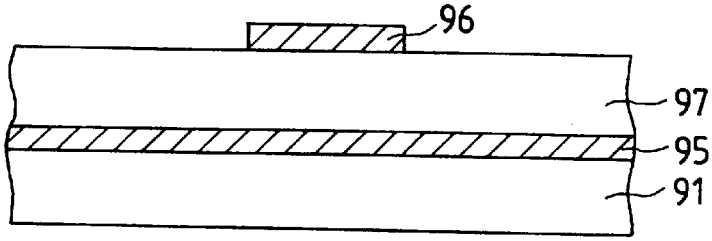

(3) A 50 Å thick Ti film and a 5,000 Å thick Au film are sequentially formed on the entire surfaces of the insulation layers 97 to produce X-directional wires 96 by vacuum deposition (FIG. 10C).

Figure 10D:
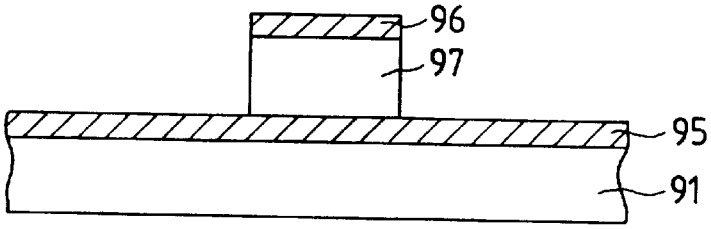

(4) The X-directional wires 96 and the insulation layers 97 are subjected to a patterning operation, employing wet etching for Au and RIE (Reactive Ion Etching) for Ti and $SiO_2$. $CF_4$ and $H_2$ gases are used for Ti and $SiO_2$ (FIG. 10D).

Figure 10E:
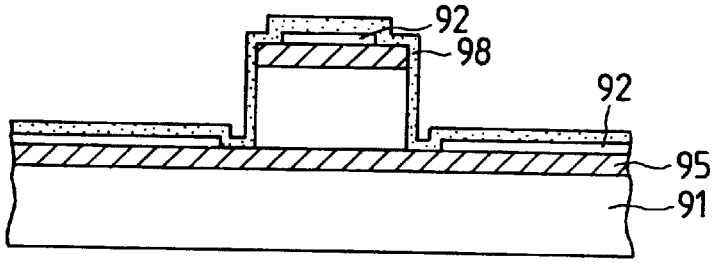
Figure 10F:
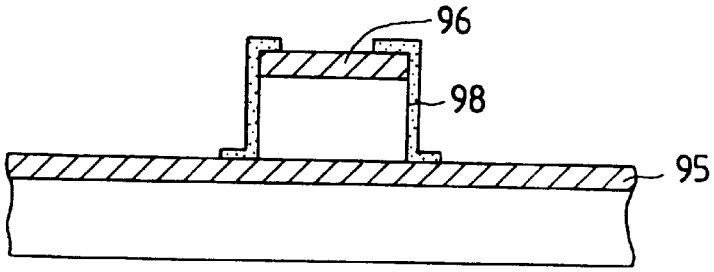

(5) After additionally forming a CR film 92 to a thickness of 0.1 $\mu$m by vapor deposition, the Cr film 92 is subjected to a patterning operation, using photolithography and etching processes, and then organic palladium solution (ccp 4230: available from Okuno Pharmaceutical Co., Ltd.) is applied thereto by means of a spin coater. Thereafter, the coated substrate is heated at 300° C. for 10 min. to produce thin films 98 for forming electron-emitting regions made of fine particles of palladium oxide (PdO) (FIG. 10E). Then, the thin films 98 are shaped to confirm to a desired pattern by lift-off (FIG. 10F).

(6) The substrate is then put into a vacuum chamber having a degree of vacuum of $10^{-6}$ Torr and a voltage is applied to the X- and Y-directional wires to energize the thin films 98 of fine particles for forming electron-emitting regions to irreversibly transform the films of fine particles and thus produce electron-emitting regions.

When voltages of 0V and 14V are applied respectively to a selected one of the X-directional wires 96 and a selected one of the Y-directional wires 95, while 7V is applied to all the remaining X-and Y-directional wires, only the electron-emitting devices at the wire crossing specified by the X- and Y-directional wires emits electrons to prove the excellent selectivity of the embodiment. Electron beams emitted from the selected electron-emitting devices are well converged to a single spot on the image-forming screen to produce a desired intensity of electron beam irradiation when the upper wire (X-directional wire 96) is made to show a potential higher than that of the lower wire (Y-directional wire 95) and the upper wire is made to have an appropriate width.

In an experiment conducted by the inventors of the present invention using this embodiment, where the X-directional wires were made to have a width (D) of 400 $\mu$m, 14V and 0V were respectively applied. to the X- and Y-directional wires whereas 6 kV was applied to the fluorescent bodies (not shown) on the image-forming screen arranged above the electron source and separated by a distance (H) of 2.5 mm to produce substantially symmetrical circular luminous spots having a diameter of approximately 500 $\mu$m.

This experiment proved that, while an electron beam emitted from a surface conduction electron-emitting device comprising a single electron-emitting region produces a poorly symmetric luminous spot of the corresponding fluorescent body disposed on the inner surface of the image-forming member, the luminous spot can be made to become highly symmetric by arranging a plurality of electron-emitting regions along the direction of voltage application (Y-direction) with the interposition of a higher voltage and separating them with a distance D that satisfies the relationship defined below as in the case of the embodiment because the electron beams from the plurality of electron-emitting regions are converged to the single luminous spot of the fluorescent body on the inner surface of the image-forming member.

$$K_2\times2H(Vf/Va)^{1/2}\geq D/2\geq K_3\times2H(Vf/Va)^{1/23}$$

where $K_2$ and $K_3$ are constants, $K_2=1.25\pm0.05$ and $K_3=0.35\pm0.05$

Vf is the voltage applied to the device,

Va is the voltage applied to the image-forming member (accelerating voltage),

H is the distance between the electron-emitting device and the image-forming member and D is the distance between any two electron-emitting devices.

An electron source prepared by the above described manufacturing process does not show any remarkable degradation in its reproducibility nor any noticeable reduction in the yield if it is used for a large high definition screen.

While the insulation films of the above embodiment have an even and uniform thickness, they may show a varying thickness without damaging the performance of the related electron-emitting regions because the film thickness in areas outside the wire crossing is not related with the operation of electron emitting devices at the wire crossing if the film thickness is appropriate at the wire crossing.

An image-forming apparatus comprising a display panel realized by using the above embodiment of electron source described in EXAMPLE 1 is driven to operate in a manner as described below.

Figure 11:
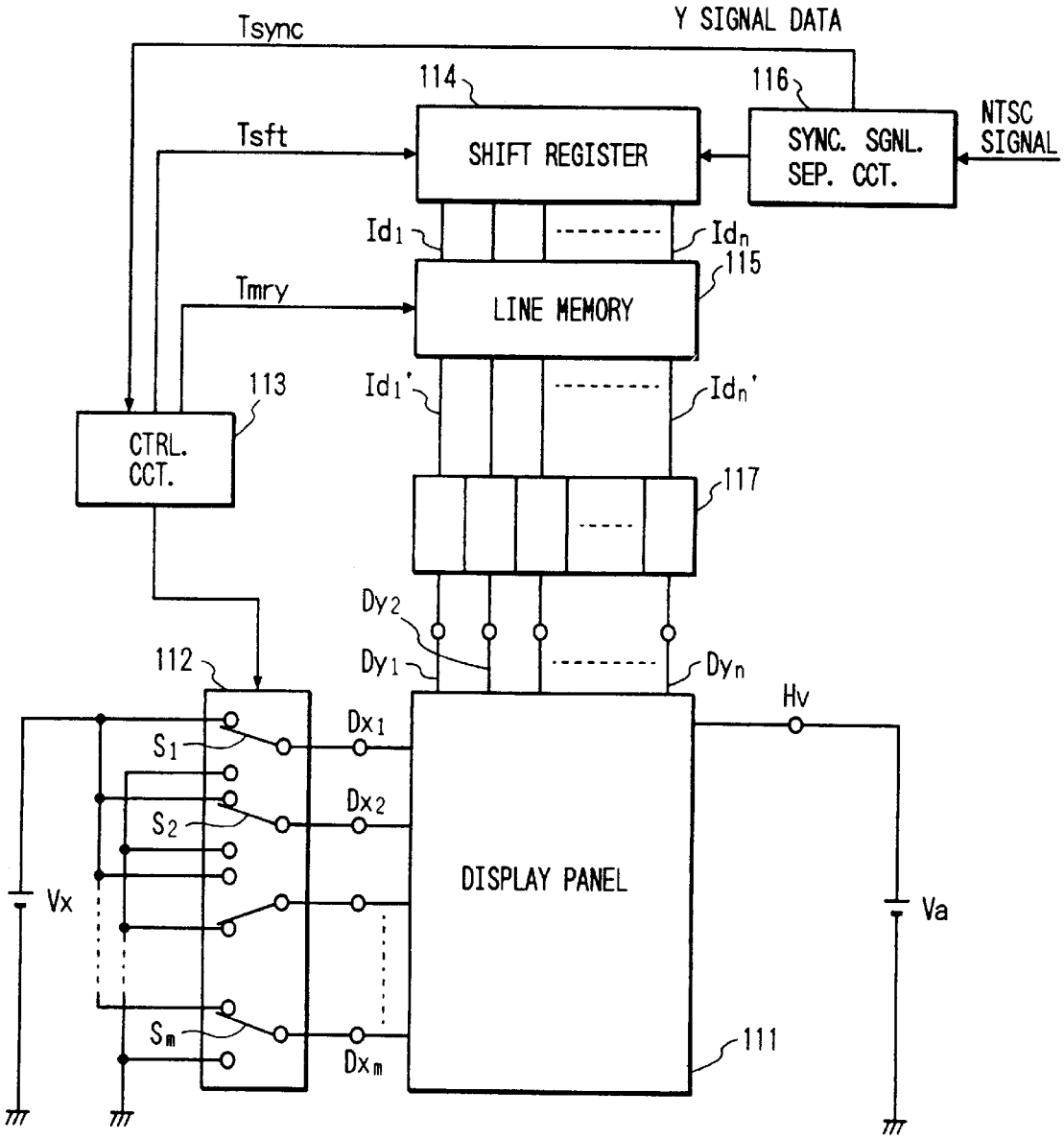
FIG. 11 is a block diagram of the electric circuit of the image-forming apparatus according to the invention.

FIG. 11 shows a block diagram of a drive circuit for driving the display panel, which is designed for image display operation using NTSC television signals. In FIG. 11, reference numeral 111 denotes the display panel. The circuit comprises further a scan circuit 112, a control circuit 113, a shift register 114, a line memory 115, a synchronizing signal separation circuit 116, a modulation signal generator and a pair of DC voltage sources Vx and Va.

Each component of the apparatus operates in a manner as described below. The display panel 111 is connected to external circuits via terminals Dx1 through Dxm, Dy1 through Dym and a high voltage terminal Hv, of which terminals Dx1 through Dxm are designed to receive scan signals for sequentially driving on a one-by-one basis the rows (of n devices) of a multiple electron beam source in the display panel 111 comprising a number of surface-conduction type electron-emitting devices arranged in the form of a matrix having m rows and n columns. On the other hand, terminals Dy1 through Dyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction electron-emitting devices.

The scan circuit 112 operates in a manner as follows. The circuit comprises m switching devices (which are schematically shown and denoted by symbols S1 and S2 in FIG. 11), each of which takes either the output voltage of the DC voltage source Vx or 0V (the ground potential) and comes to be connected with one of the terminals Dx1 through Dxm of the display panel 111. Each of the switching devices S1 through Sm operates in accordance with control signal Tscan fed from the control circuit 113 and can be easily prepared by combining transistors such as FETs.

The DC voltage source Vx of this embodiment is designed to output a constant voltage of 7V taking the characteristic properties of the surface conduction electron-emitting devices into consideration.

The control circuit 113 coordinates the operations of related components so that images may be appropriately displayed in accordance with externally fed picture signals. It generates control signals Tscan, Tsft and Tmry for the related components in response to synchronizing signal Tsync fed from the synchronizing signal separation circuit 116. These control signals will be described later in greater detail by referring to FIG. 18.

The synchronizing signal separation circuit 116 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 116 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 114, is designated as DATA signal.

The shift register 114 carries out for each line a serial/parallel conversion on DATA signals that are serially fed on a time series basis in accordance with control signal Tsft fed from the control circuit 113. (In other words, a control signal Tsft operates as a shift clock for the shift register 114.) A set of data for a line that have undergone a serial/parallel conversion (and correspond to a set of drive data for n electron-emitting devices) are sent out of the shift register 114 as n parallel signals Id1 through Idn.

The line memory 115 is a memory for storing a set of data for a line, which are signals Id1 through Idn, for a required period of time according to control signal Tmry coming from the control circuit 113. The stored data are sent out as I'd1 through I'dn and fed to modulation signal generator 117.

Figure 17A:
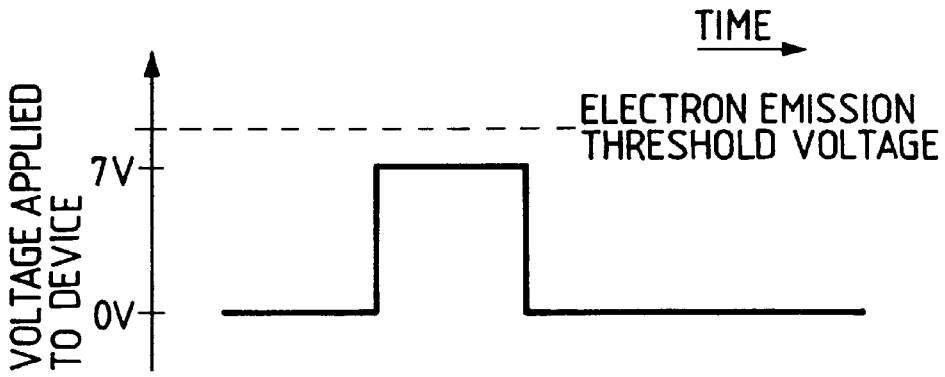
FIGS. 17A and 17B are graphs showing threshold voltages of a surface conduction electron-emitting device to be used for the purpose of the invention.
Figure 17B:
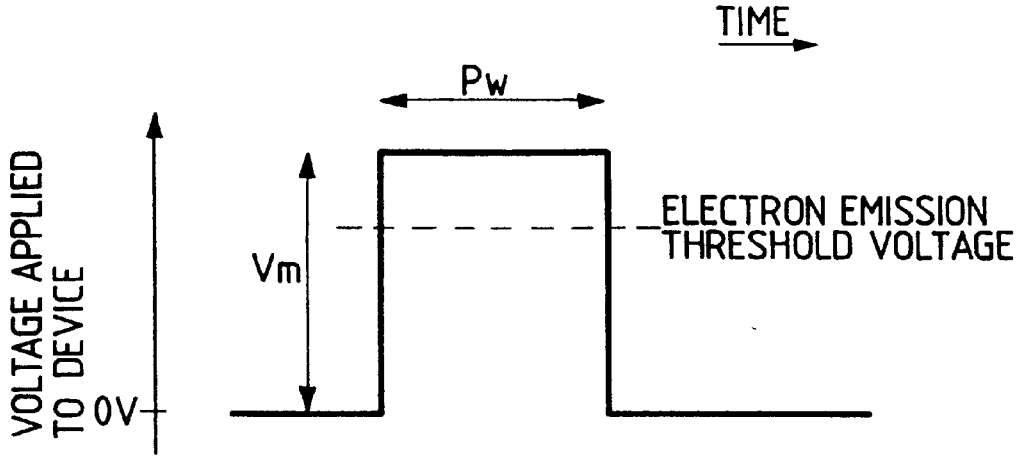

The modulation signal generator 117 is in fact a signal source that appropriately drives and modulates the operation of each of the surface conduction electron-emitting devices according to each of the picture data I'd1 through I'dn and output signals of this device are fed to the surface conduction electron-emitting devices in the display panel 111 via terminals Dy1 through Dyn. As described above by referring to the embodiments and FIG. 5, an electron emitting device according to the present invention is characterized by the following three features in terms of emission current Ie. As seen in FIG. 17A, there exists a clear threshold voltage below and the electron-emitting devices substantially does not emit any electron when a voltage that falls short of the threshold voltage is applied thereto. On the other hand, as seen in FIG. 17B, when the voltage applied to the surface conduction electron emitting devices exceeds the threshold level, the rate of electron beam emission of the surface conduction electron emitting devices can be controlled by appropriately modifying the pulse width Pw or the amplitude Vm of the pulsed voltage being applied to the devices. Therefore, the modulation signal generator 117 may be either a pulse width modulation type that generates a pulse with a constant voltage and modulates the pulse width according to the input data or a voltage modulation type that generates a voltage pulse having a constant pulse width and modulates the amplitude of the voltage pulse according to the input data.

As each component of the embodiment has been described above in detail by referring to FIG. 11, the operation of the display panel 111 will now be discussed here in detail by referring to FIGS. 12 through 15A to 15M and then the overall operation of the embodiment is described.

For the sake of convenience of explanation, it is assumed here that the display panel comprises 6×6 pixels (or m=n=6), although it may be needless to say that by far much more pixels are used for a display panel in actual applications.

Figure 12:
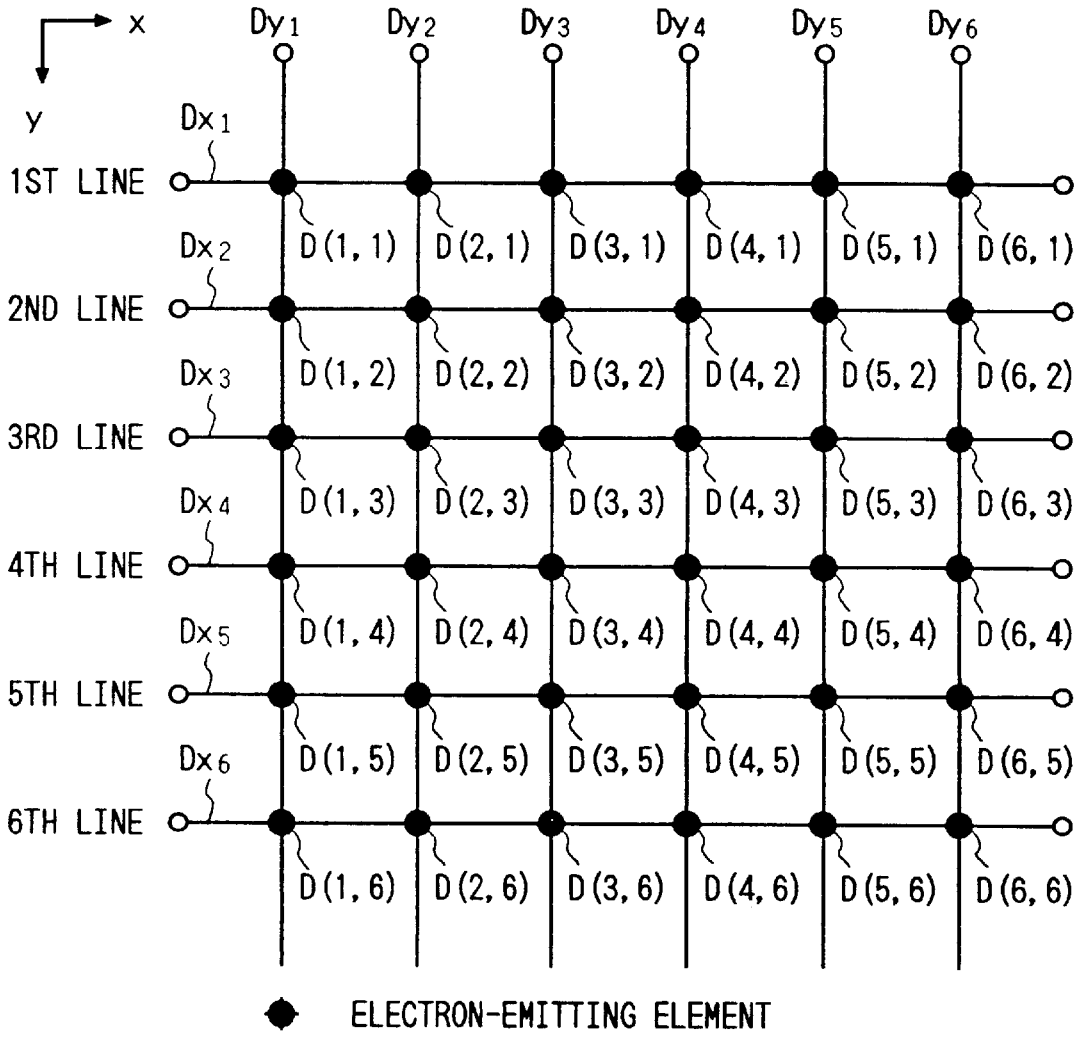
FIG. 12 is a schematic diagram of the electron source according to the invention, showing an arrangement of electron-emitting devices.

The multiple electron beam source of FIG. 12 comprises surface conduction electron-emitting devices arranged and wired in the form of a matrix of six rows and six columns. For the convenience of description, a (X, Y) coordinate is used to locate the devices. Thus, the locations of the devices are expressed as, for example, D(1, 1), D(1, 2) and D(6, 6).

In the operation of displaying images on the display panel of the embodiment by driving a multiple electron beam sources as described above, an image is divided into a number of narrow strips, or lines as referred to hereinafter, running in parallel with the X-axis so that the image may be restored on the panel when all the lines are displayed there, the number of lines being assumed to be six here. In order to drive a row of electron-emitting devices that is responsible for an image line, 0V is applied to the terminal of the horizontal wire corresponding to the row of devices, which is one of Dx1 through Dx6, while 7V is applied to the terminals of all the remaining wires. In synchronism with this operation, a modulation signal is given to each of the terminals of the vertical wires Dy1 through Dy6 according to the image of the corresponding line.

Figure 13:
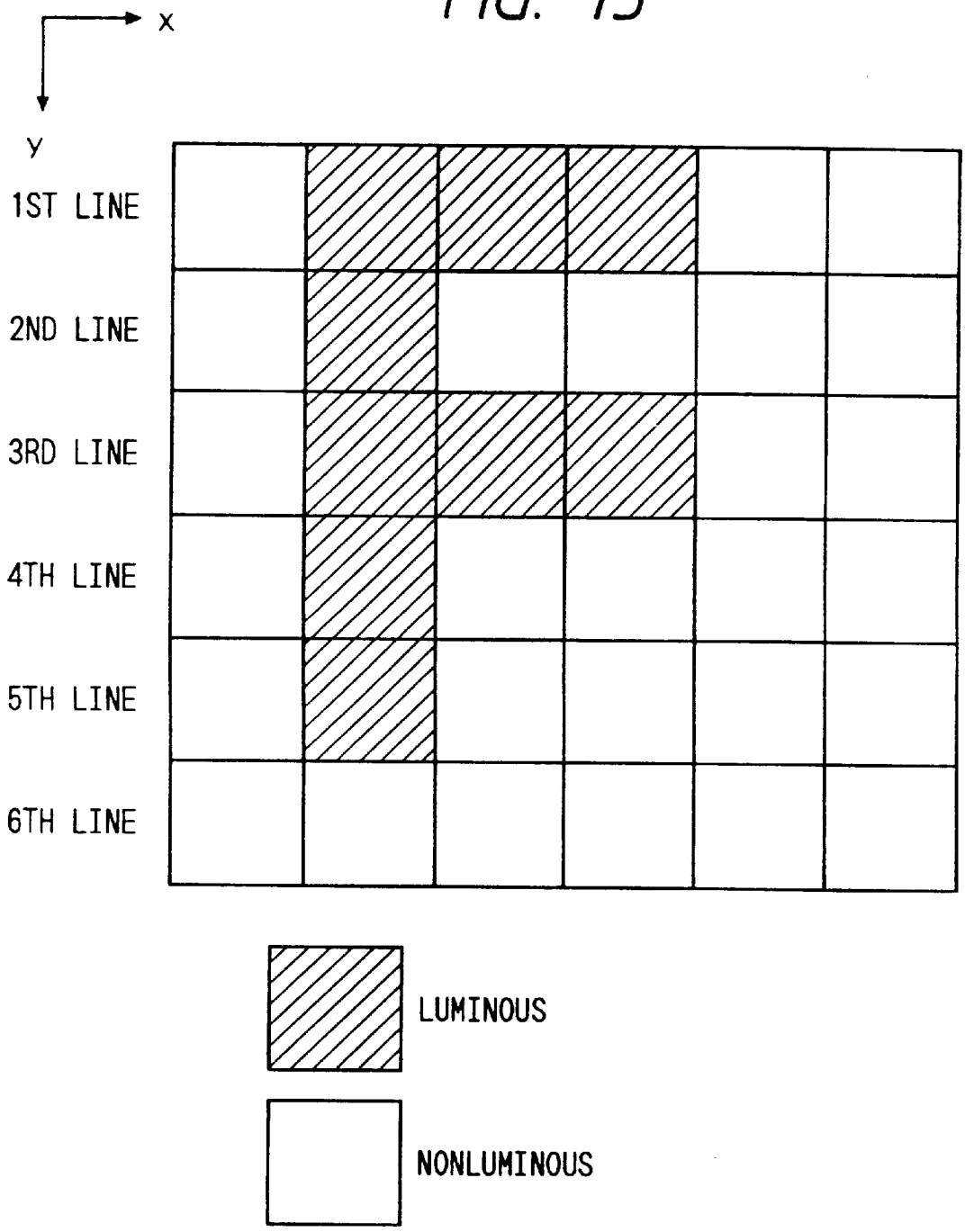
FIG. 13 is a schematic illustration of an image that can be displayed by using the electron source of FIG. 12.

Assume now that an image as illustrated in FIG. 13 is displayed on the panel and all the bright spots, or pixels, of the panel have an identical luminance, which is equal to 100 fL (footLambert). While known fluorescent material P-22 is used for the above display panel 111 comprising surface conduction electron-emitting devices having the above described features, to which a voltage of 10 kV is applied, and the image on the panel is updated at a frequency of 60 Hz, a voltage of 14V is most suitably applied for 10 $\mu$sec. to the electron-emitting devices for a display panel having 6×6 pixels in order to achieve a luminance of 100 fL. (Note, however, that these values are subject to alterations depending on changes in the parameters.)

Figure 14:
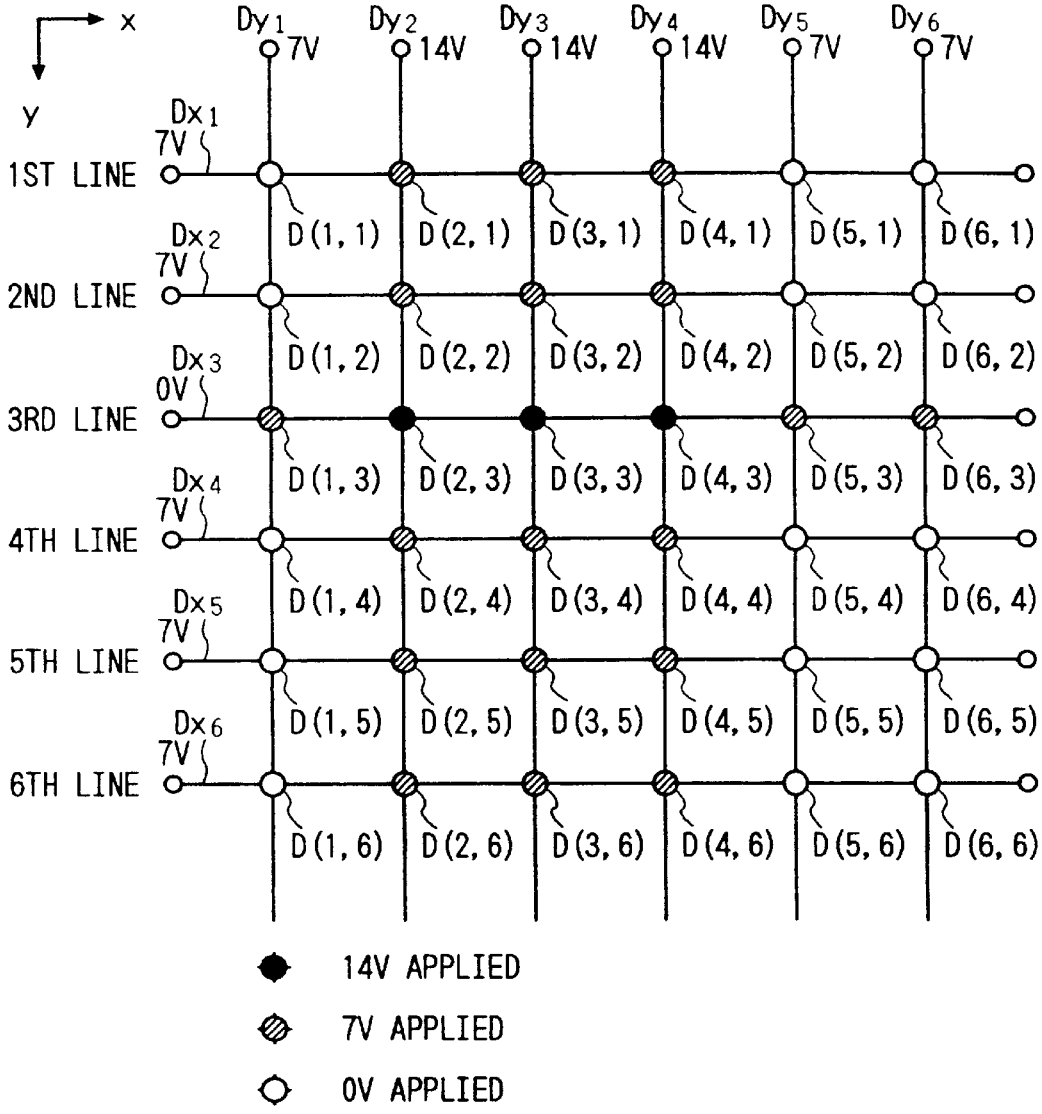
FIG. 14 is a diagram showing voltages applied to the electron-emitting devices of FIG. 12 to produce the image of FIG. 13.
Figures 15A, 15B, 15C, 15D, 15E, 15F, 15G, 15H, 15I, 15J, 15K, 15L, 15M:
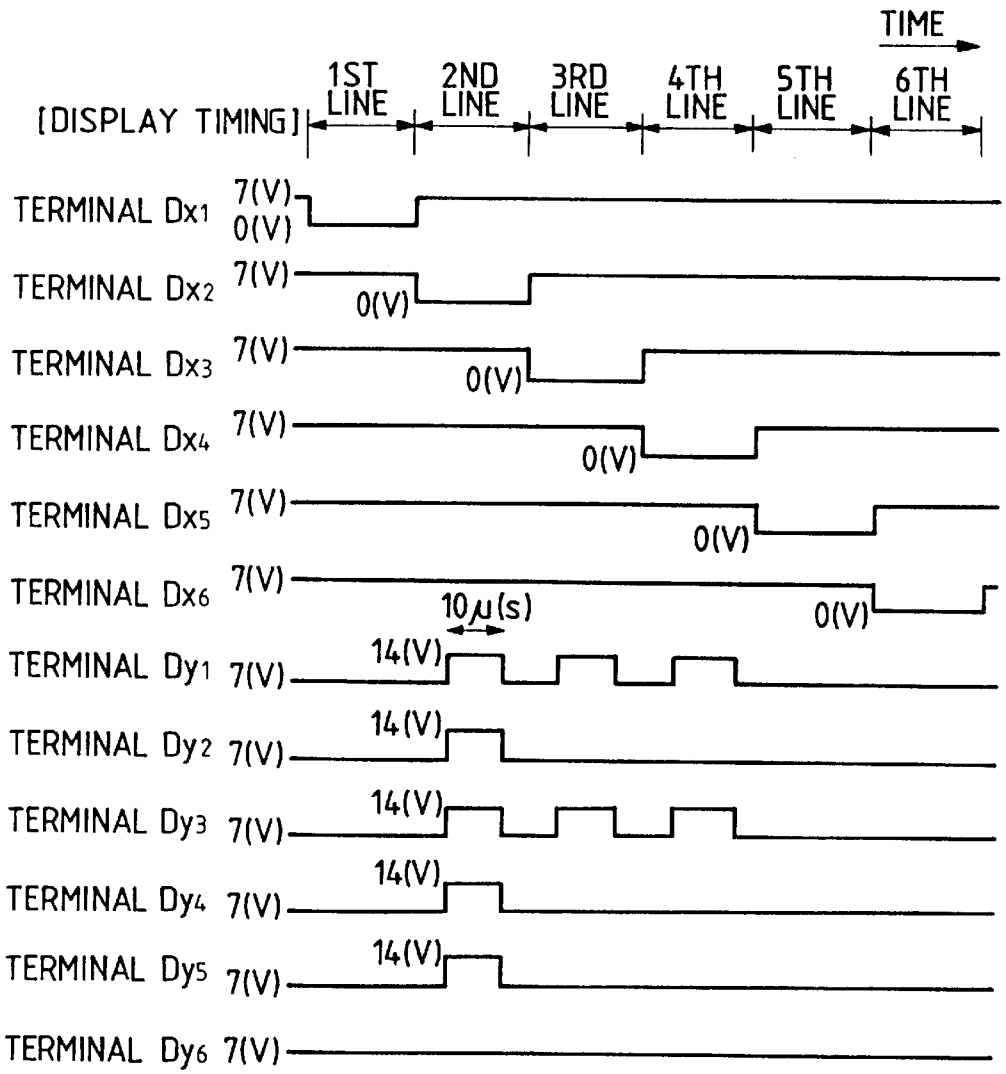
FIGS. 15A through 15M show in combination a timing chart for applying the voltages of FIG. 14.

Assume further that, in FIG. 13, the operation is currently on the stage of making the third line turn bright. FIG. 14 shows what voltages are applied to the multiple electron beam source by way of the terminals Dx1 through Dx6 and Dy1 through Dy6. As seen in FIG. 14, a voltage of 14V which is by far above the threshold voltage for electron emission is applied to each of the surface conduction electron-emitting devices D(2, 3), D(3, 3) and D(4, 3) (black devices) of the beam source, whereas 7V or 0V is applied to each of the remaining devices (7V to shaded devices and 0V to white devices). Since these voltages are lower than the threshold voltage, these devices do not substantially emit electron beams at all.

In the same way, the multiple electron beam source is driven to operate for all the other lines on a time series basis in order to produce an image of FIG. 13. FIGS. 15A to 15M show waveform timing charts for the above operation. As seen in FIGS. 15A to 15M, the lines are driven sequentially, starting from the first line and the operation of driving all the lines is repeated at a rate of 60 times per second so that images may be displayed without flickering.

The luminance of the display screen can be modified by changing either the pulse width or the amplitude of the pulsed voltage of the modulation signal applied to a selected one of the terminals Dy1 through Dy6.

A multiple electron beam source having 6×6 pixels as described above is driven typically by using a drive circuit as illustrated in FIG. 11 and following a timing chart as shown in FIGS. 16A to 16F.

Figures 16A, 16B, 16C, 16D, 16E, 16F:
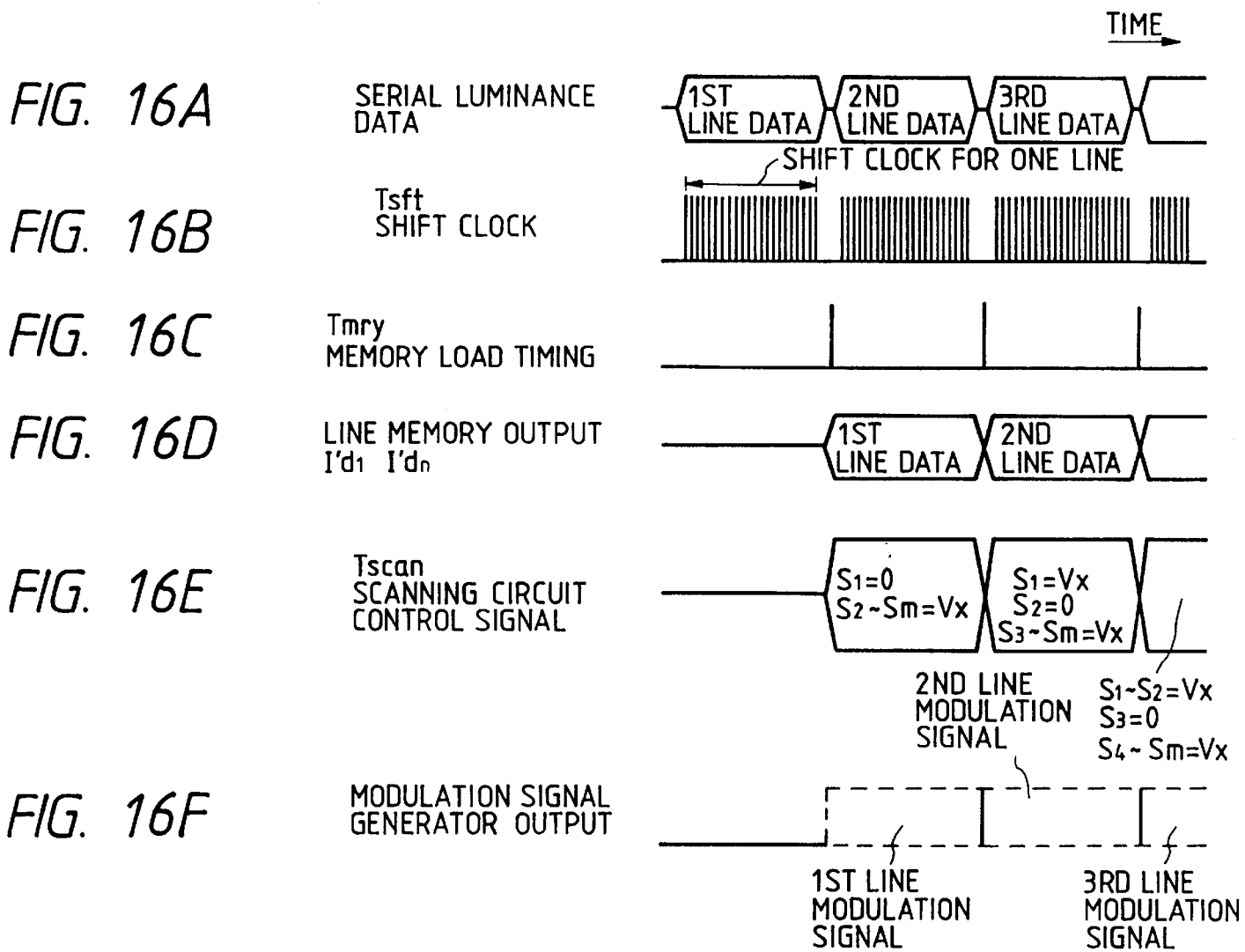
FIGS. 16A through 16F show in combination a timing chart for the entire operation of the image-forming apparatus of FIG. 11.

In FIG. 16A shows the timing of operation of luminance signal DATA which is singled out from an externally fed NTSC signal by the synchronizing signal separation circuit 116. As shown, the data for the first line, those for the send line, those for the third line and so forth are separately sent out as output signals. In synchronism with these, the control circuit 113 transmits shift clocks Tsft as shown in FIG. 16B to the shift register 114.

When data are stored in the shift register 114 for a line, the control circuit 113 transmits a memory write signal Tmry at a timing shown in FIG. 16C and drive data for a line (n devices) are written in the line memory 115. Consequently, output signals I'd1 through I'dn of the line memory 115 are changed at respective timings shown in FIG. 16D.

On the other hand, control signal Tscan for controlling the operation of the scan circuit 112 is shown in FIG. 16E. More specifically, when the first lint is driven, only the switching device S1 in the scan circuit 112 is held to 0V, whereas the other switching devices are held to 7V. When the second line is driven, only the switching device S2 is held to 0V, whereas the other switching devices are held to 7V and so on.

In synchronism with the above operation, a modulation signal is transmitted from the modulation signal generator 117 to the display panel 111 with the timing as shown in FIG. 16F.

Thus, television images can be displayed on the display panel 111 in the above described manner.

Although it is not particularly mentioned above that the shift register 114 and the line memory 115 may be either of digital or of analog signal type so long as serial/parallel conversions and storage of video signals are conducted at a given rate. If digital signal type devices are used, output signal DATA of the synchronizing signal separation circuit 116 needs to be digitized. However, such conversion can be easily carried out by arranging an A/D converter at the output of the synchronizing signal separation circuit 116.

While the present invention is described for the above embodiment in terms of television image display using the NTSC television signal system, an image-forming apparatus according to the invention can be suitably used for other television signal systems as well as other image signal sources including computers, image memories and telecommunications networks by directly or indirectly connecting it to any of such sources particularly when it is necessary to display a large quantity of data on a large display screen.

FIG. 18 shows a block diagram of an image display system incorporating a display apparatus adapted for displaying image data coming from a variety of image data sources such as television broadcasting on a display panel comprising a electron source according to the invention. In FIG. 18, the system comprises a display panel 200, a display panel drive circuit 201, a display controller 202, a multiplexer 203, a decoder 204, an input/output interface circuit 205, a CPU 206, an image generation circuit 207, image memory interface circuits 208, 209 and 210, an image input interface circuit 211, TV signal reception circuits 212 and 213 and an input section 214. (Note that, if the display apparatus is used for TV signals or other signals containing both image data and sound data, the system comprises as a matter of course a sound reproduction system as well as the image display system shown in FIG. 18 as a component thereof. However, circuits for reception, separation, reproduction, processing and storage of sound data and speakers are omitted from FIG. 18 because they are not directly related to the present invention.)

Now, the components of the system of FIG. 18 will be described, following the flow of image data therethrough.

Firstly, the TV signal reception circuit 213 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system'such as the MUSE system) because it can be used for a large display panel comprising a large number of pixels. The TV signals received by the TV signal reception circuit 213 are forwarded to the decoder 204.

Secondly, the TV signal reception circuit 212 is a circuit for receiving TV image signals transmitted via a wired transmission system using coaxial cables and/or optical fibers. Like the TV signal reception circuit 213, the TV signal system to be used is not limited to a particular one and the TV signals received by the circuit are forwarded to the decoder 204.

The image input interface circuit 211 is a circuit for capturing image signals supplied from an image input device such as a TV camera or an image reading scanner and the captured image signals are forwarded to the decoder 204.

The image memory interface circuit 210 is a circuit for retrieving image signals stored in a video tape recorder (hereinafter referred to as VTR) and the retrieved image signals are also forwarded to the decoder 204.

The image memory interface circuit 209 is a circuit for retrieving image signals stored in a video disk and the retrieved image signals are forwarded to the decoder 204.

The image memory interface circuit 208 is a circuit for retrieving image signals stored in a device for storing still image data such as so-called still disc and the retrieved image signals are also forwarded to the decoder 204.

The input/output interface circuit 205 is a circuit for connecting the display apparatus and an external output signal source such as a computer, a computer network or a printer. It carries out input/output operations for image data and data on characters and graphics and, if appropriate, for control signals and numerical data between the CPU 206 of the display apparatus and an external output signal source.

The image generation circuit 207 is a circuit for generating image data to be displayed on the display screen on the basis of the image data and the data on characters and graphics input from an external output signal source via the input/output interface circuit 205 or those coming from the CPU 206. The circuit comprises reloadable memories for storing image data and data on characters and graphics, read-only memories for storing image patterns corresponding given character codes, a processor for processing image data and other circuit components necessary for the generation of screen images.

Image data generated by the circuit for display are sent to the decoder 204 and, if appropriate, they may also be sent to an external circuit such as a computer network or a printer via the input/output interface circuit 205.

The CPU 206 controls the display apparatus and carries out the operation of generating, selecting and editing images to be displayed on the display screen.

For example, the CPU 206 sends control signals to the multiplexer 203 and appropriately selects or combines signals for images to be displayed on the display screen. At the same time it generates control signals for the display panel controller 202 and controls the operation of the display apparatus in terms of image display frequency, scanning method (e.g., interlaced scanning or non-interlaced scanning), the number of scanning lines per frame and so on.

The CPU 206 also sends out image data and data on characters and graphic directly to the image generation circuit 207 and accesses external computers and memories via the input/output interface circuit 205 to obtain external image data and data on characters and graphics.

The CPU 206 may additionally be so designed as to participate other operations of the display apparatus including the operation of generating and processing data like the CPU of a personal computer or a word processor.

The CPU 206 may also be connected to an external computer network via the input/output interface circuit 205 to carry out computations and other operations, cooperating therewith.

The input section 214 is used for forwarding the instructions, programs and data given to it by the operator to the CPU 206. As a matter of fact, it may be selected from a variety of input devices such as keyboards, mice, joysticks, bar code readers and voice recognition devices as well as any combinations thereof.

The decoder 204 is a circuit for converting various image signals input via said circuits 207 through 213 back into signals for three primary colors, luminance signals and I and Q signals. Preferably, the decoder 204 comprises image memories as indicated by a dotted line in FIG. 18 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 204 in cooperation with the image generation circuit 207 and the CPU 206.

The multiplexer 203 is used to appropriately select images to be displayed on the display screen according to control signals given by the CPU 206. In other words, the multiplexer 203 selects certain converted image signals coming from the decoder 204 and sends them to the drive circuit 201. It can also divide the display screen in a plurality of frames to display different images simultaneously by switching from a set of image signals to a different set of image signals within the time period for displaying a single frame.

The display panel controller 202 is a circuit for controlling the operation of the drive circuit 201 according to control signals transmitted from the CPU 206.

Among others, it operates to transmit signals to the drive circuit 201 for controlling the sequence of operations of the power source (not shown) for driving the display panel in order to define the basic operation of the display panel.

It also transmits signals to the drive circuit 201 for controlling the image display frequency and the scanning method (e.g., interlaced scanning or non-interlaced scanning) in order to define the mode of driving the display panel.

If appropriate, it also transmits signals to the drive circuit 201 for controlling the quality of the images to be displayed on the display screen in terms of luminance, contrast, color tone and sharpness.

The drive circuit 201 generates a drive signal to be applied to the display panel 200 and operates according to image signals inputted from the multiplexer 203 and control signals inputted from the display panel controller 202.

A display apparatus according to the invention and having a configuration as described above and illustrated in FIG. 18 can display on the display panel 200 various images given from a variety of image data sources. More specifically, picture signals such as television picture signals are converted back by the decoder 204 and then selected by the multiplexer 203 before sent to the drive circuit 201. On the other hand, the display controller 202 generates control signals for controlling the operation of the drive circuit 201 according to the picture signals for the pictures to be displayed on the display panel 200. The drive circuit 201 then applies drive signals to the display panel 200 according to the picture signals and the control signals. Thus, images are displayed on the display panel 200. All the above described operations are controlled by the CPU 206 in a coordinated manner.

The above described display apparatus can not only select and display particular pictures out of a number of images given to it but also carry out various image processing operations including those for enlarging, reducing, rotating, emphasizing edges of, thinning out, interpolating, changing colors of and modifying the aspect ratio of images and editing operations including those for synthesizing, of erasing, connecting, replacing and inserting images as the image memories incorporated in the decoder 204, the image generation circuit 207 and the CPU 206 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 18 shows only an example of possible configuration of a display apparatus comprising a display panel provided with an electron source prepared by arranging a number of surface conduction electron-emitting devices and the present invention is not limited thereto. For example, some of the circuit components of FIG. 18 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

Since a display apparatus according to the invention comprises a display panel that is provided with an electron source prepared by arranging a large number of surface conduction electron-emitting devices and hence adaptable to reduction in the depth, the overall apparatus can be made very thin. Additionally, since a display panel comprising an electron source prepared by arranging a large number of surface conduction electron-emitting devices is adapted to have a large display screen with an enhanced luminance and provide a wide angle for viewing, it can offer really impressive scenes to the viewers.

Embodiment 2

Figure 19A:
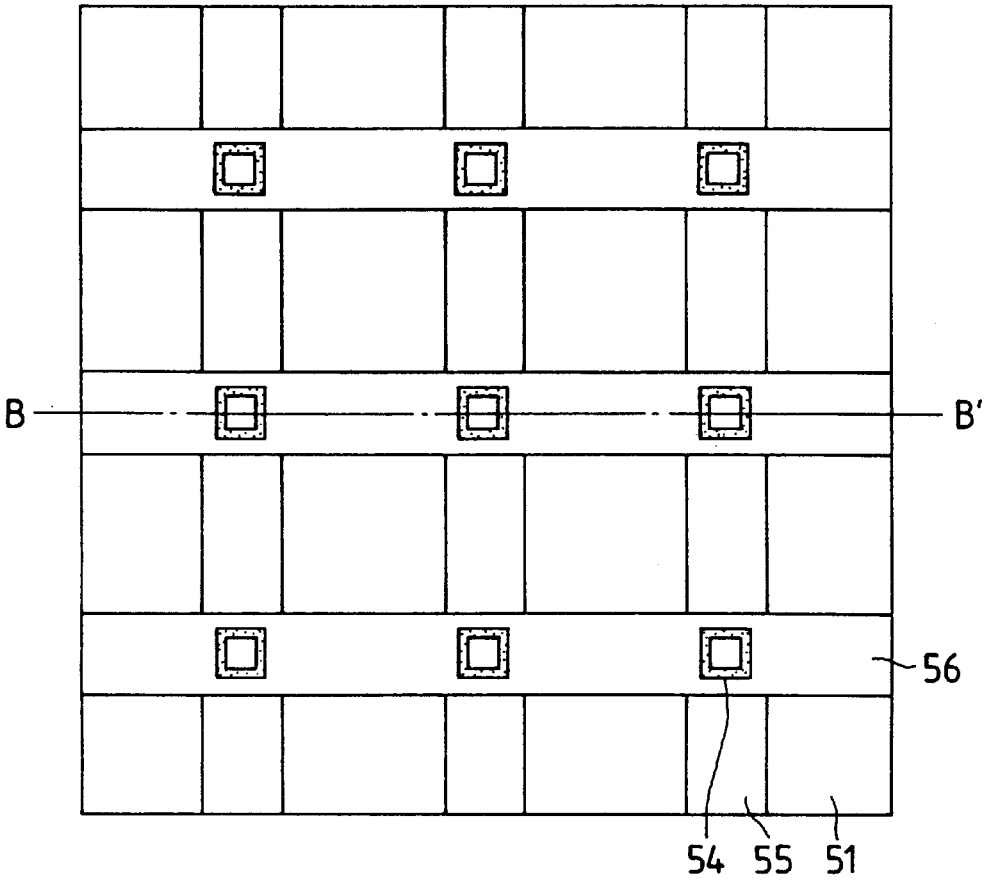
FIGS. 19A and 19B are schematic partial views of the electron source of a second embodiment of the image-forming apparatus according to the invention.
Figure 19B:
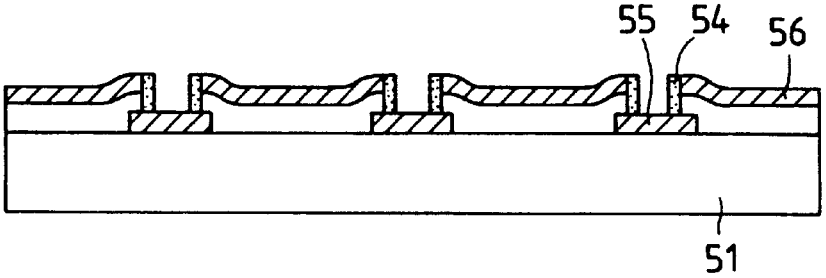

FIGS. 19A and 19B are schematic views of a second embodiment of an electron source according to the invention, of which FIG. 19A is a plan view and FIG. 19B is a sectional view taken along line B–B' of FIG. 19A. Reference symbols in FIGS. 19A and 19B denote the components that are same or similar to those of the embodiment of FIGS. 5A and 5B. This embodiment is prepared by following the manufacturing steps as described earlier by referring the first embodiment except that the insulation layers are made to have a thickness of 1 $\mu$m in step (2) and the insulation layers are processed in a patterning operation to show holes located at the crossings of the X-directional wires 56 and the Y-directional wires 55 in step (4). Electron emitting regions are formed in the holes. When the embodiment is used for an image-forming apparatus as in the case of the first embodiment, it operates excellently for electron beam emission and hence does not show any remarkable reduction in the yield if it is used for a large definition screen and, therefore, it can suitably be used for television.

Embodiment 3

Figure 20:
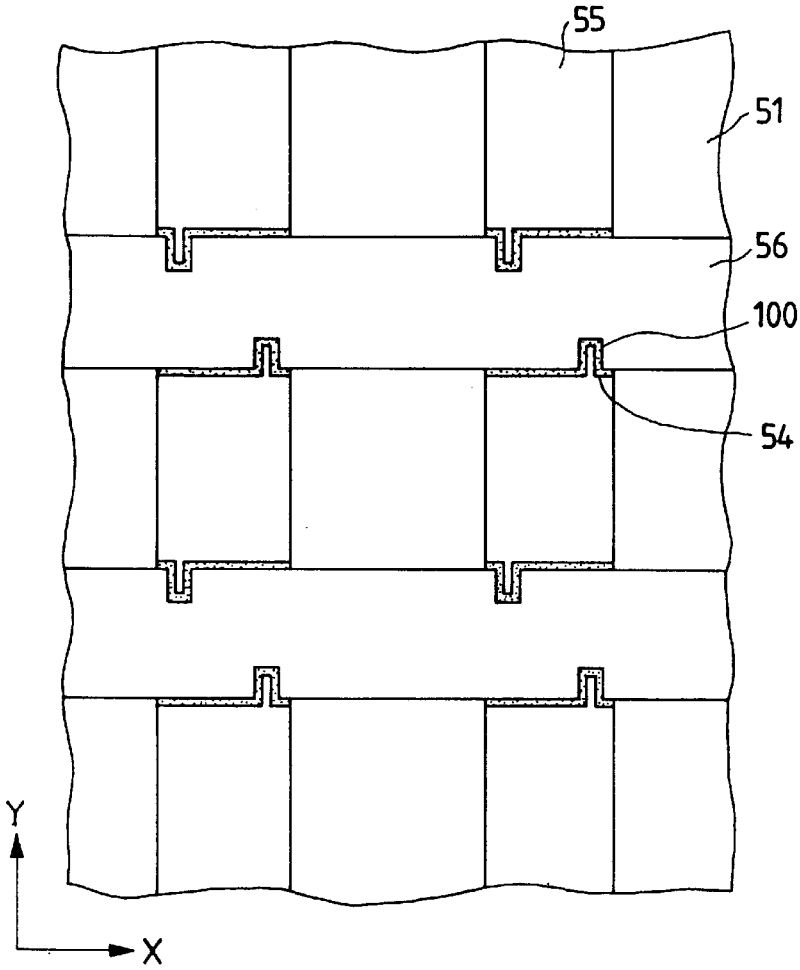
FIG. 20 is a schematic partial plan view of the electron source of a third embodiment of the image-forming apparatus according to the invention.
Figure 21:
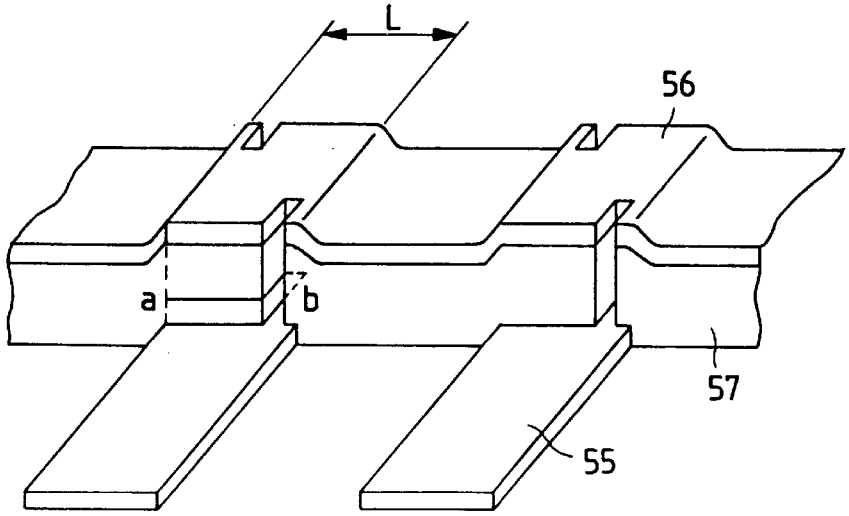
FIG. 21 is a schematic partial perspective view of the electron source of the third embodiment of FIG. 20.

FIG. 20 is a schematic partial pan view of a third embodiment of electron source according to the invention. This embodiment is realized by arranging a recess 100 at each lateral side of the insulation layers where an electron emitting region is formed. FIG. 21 is a schematic partial perspective view of the third embodiment. While this embodiment comprises electron-emitting devices and wires arranged to show a density as high as that of the first embodiment, the effective length of each of the thin films 54 including a electron-emitting region is greater than its counterpart of the first embodiment to increase the rate of electron beam emission of the electron-emitting region because the length of the line a-b along the lateral side of the insulation layers carrying a recess is greater than the distance L connecting the points a and b. When the embodiment is used for an image-forming apparatus as in the case of the first embodiment, it operates excellently for electron beam emission and hence does not show any remarkable reduction in the yield if it is used for a large high definition screen and, therefore, it can suitably be used for television. With the arrangement of recesses, the operation of electron beam emission of the embodiment can be controlled in terms of the trace of electron beam and the angle of emission and the embodiment can have a certain extent of redundancy.

Although this embodiment is prepared by following the manufacturing steps of the first embodiment, the X-directional wires may alternatively be formed by printing to show any intentionally bent form if a screen is used for the printing operation in an appropriately controlled manner.

Embodiment 4

Figure 22:
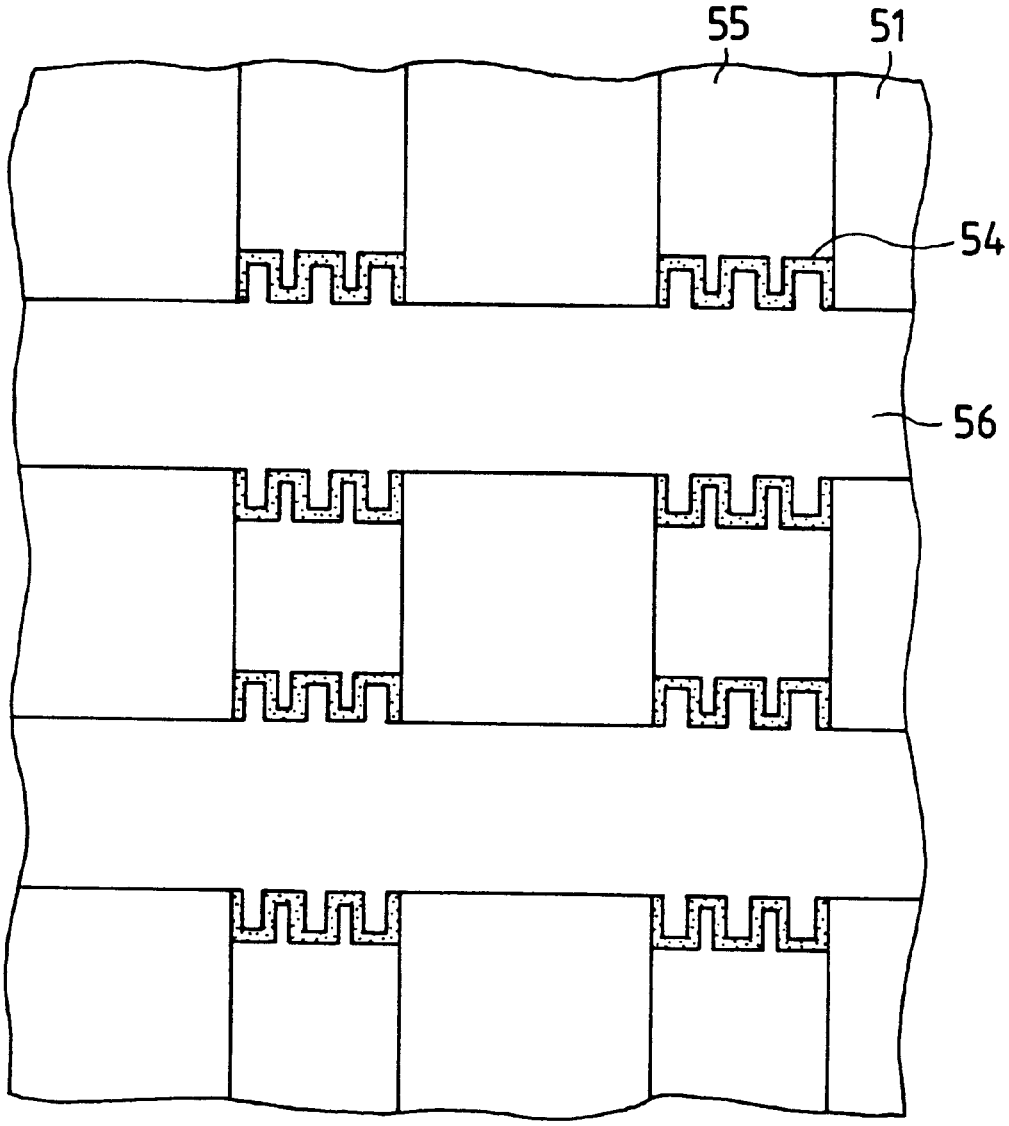
FIG. 22 is a schematic partial plan view of the electron source of a fourth embodiment of the image-forming apparatus according to the invention.

FIG. 22 is a schematic partial plan view of a fourth embodiment of electron source according to the invention and comprising insulation layers that have a profile different from that of their counterparts of the third embodiment at lateral sides. This embodiment resembles the third embodiment in that it has an enhanced rate of electron beam emission. Like the first through third embodiments, when this embodiment is used for an image-forming apparatus as in the case of the first embodiment, it operates excellently for electron beam emission and hence does not show any remarkable reduction in the yield if it is used for a large high definition screen and, therefore, it can suitably be used for television.

Embodiment 5

Figure 23A:
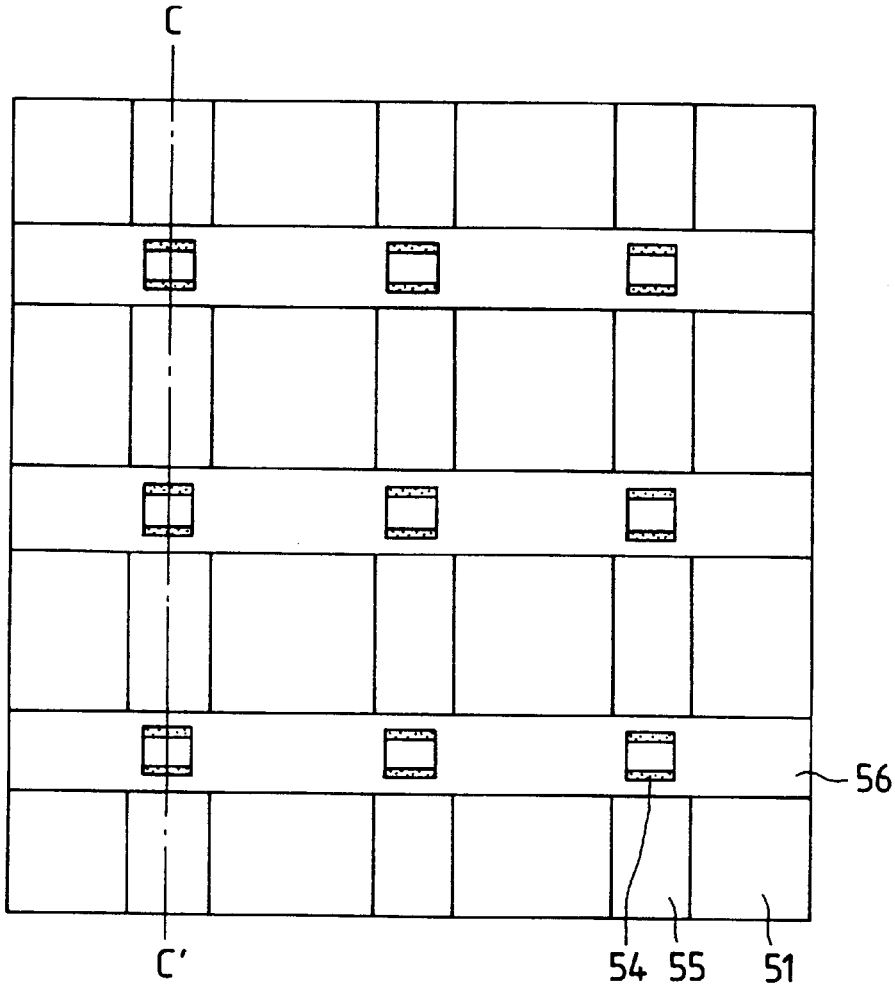
FIGS. 23A and 23B are schematic partial views of the electron source of a fifth embodiment of the image-forming apparatus according to the invention.
Figure 23B:
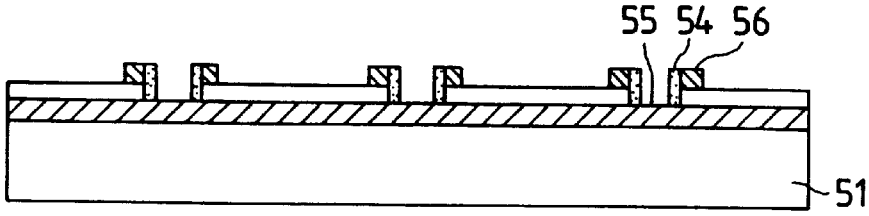

FIGS. 23A and 23B are schematic views of a fifth embodiment of electron source according to the invention, of which FIG. 23A is a plan view and FIG. 23B is a sectional view taken along line C–C' of FIG. 23A. Like the second embodiment, the insulation layers of this embodiment are processed in a patterning operation to show a recess located at the crossings of the X-directional wires 56 and the Y-directional wires 55. On the other hand, while the second embodiment has an electron-emitting region at all the lateral sides of each recess, this embodiment has an electron-emitting region only at a pair of oppositely disposed lateral sides of each recess and electron beams emitted from these electron-emitting regions are converged to a single luminous spot on the image-forming screen of an image-forming apparatus. Like the second embodiment, when this embodiment is used for an image-forming apparatus as in the case of the first embodiment, it operates excellently for electron beam emission and hence does not show any remarkable reduction in the yield if it is used for a large high definition screen and, therefore, it can suitably be used for television.

Embodiment 6

An electron source as illustrated in FIGS. 6A and 6B and described earlier is prepared, following the manufacturing steps described below by referring to FIGS. 24A through 24D.

Figure 24A:
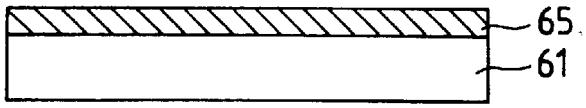
FIGS. 24A through 24D schematically illustrate different steps of manufacturing the electron source of FIGS. 6A and 6B.
Figure 24B:
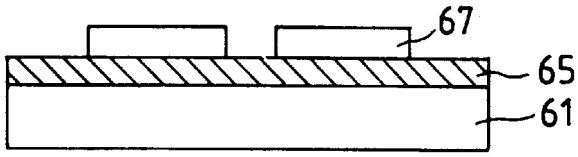

(1) After thoroughly scrubbing a quartz insulator substrate 61 with a neutral detergent and ultrasonically cleansing it, using an organic solvent, a resist pattern is formed thereon by photolithography. Thereafter, a 0.05 μm thick Ti film is formed on the resist pattern as an underlayer for improving the adherence of the overlying layers and then a 0.95 μm thick Ni film is formed thereon for Y-directional wires to entirely cover the resist pattern by vapor deposition. Then, Y-directional wires are produced by lift-off (FIG. 24A).

Figure 24C:
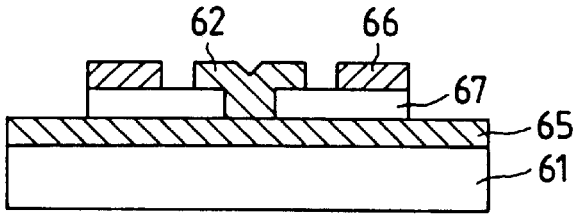
Figure 24D:
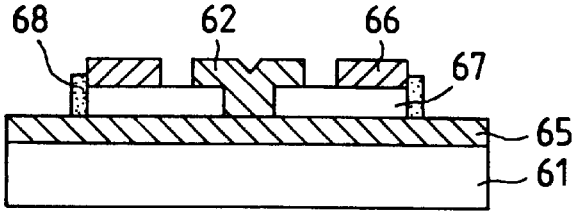

(2) An $SiO_2$ film is formed on the substrate to produce an insulation layer 67 having a film thickness of approximately 2 μm by sputtering. Then, a resist pattern is formed thereon by photolithography and the interlayer insulation layer 67 is processed by RIE (Reactive Ion Etching) (FIG. 24B), (3) Another resist pattern is formed by photolithography and a film of a material containing Ni as a principal ingredient is formed to a thickness of approximately 1 μm for X-directional wire wires by vapor deposition. Then, X-directional wires 66 and auxiliary electrodes 62 are produced by lift-off (FIG. 24C).

(4) Organic palladium Solution (ccp4230: available from Okuno Pharmaceutical Co., Ltd.) is dispersedly applied to the surface of the substrate and then baked in the atmosphere at 300° C. for 12 minutes. Then, still another resist pattern is formed by photolithography and thin films for forming electron-emitting regions 68 are formed at lateral sides of the interlayer insulation layers 67 by RIE.

(5) The substrate is then put into a vacuum chamber having a degree of vacuum of $10^6$ Torr and a voltage is applied to the X- and Y-directional wires to energize the thin films 68 of fine particles for forming electron-emitting regions. The forming voltage is 5V and this processing operation is conducted for 60 seconds to irreversibly transform the films of fine particles and thus produce electron-emitting regions.

When voltages of 0V and 14V are applied respectively to a selected one of the X-directional wires 66 and a selected one of the Y-directional wires 65, while 7V is applied to all the remaining X- and Y-directional wires, only the electron-emitting devices at the wire crossing specified by the X- and Y-directional wires emits electrons to prove the excellent selectivity of the embodiment. Electron beams emitted from the selected electron-emitting devices are well converged to a single spot on the image-forming screen.

This embodiment operates excellently for electron beam emission and hence does not show any remarkable reduction in the yield if it is used for a large high definition screen.

Embodiment 7

Figure 25A:
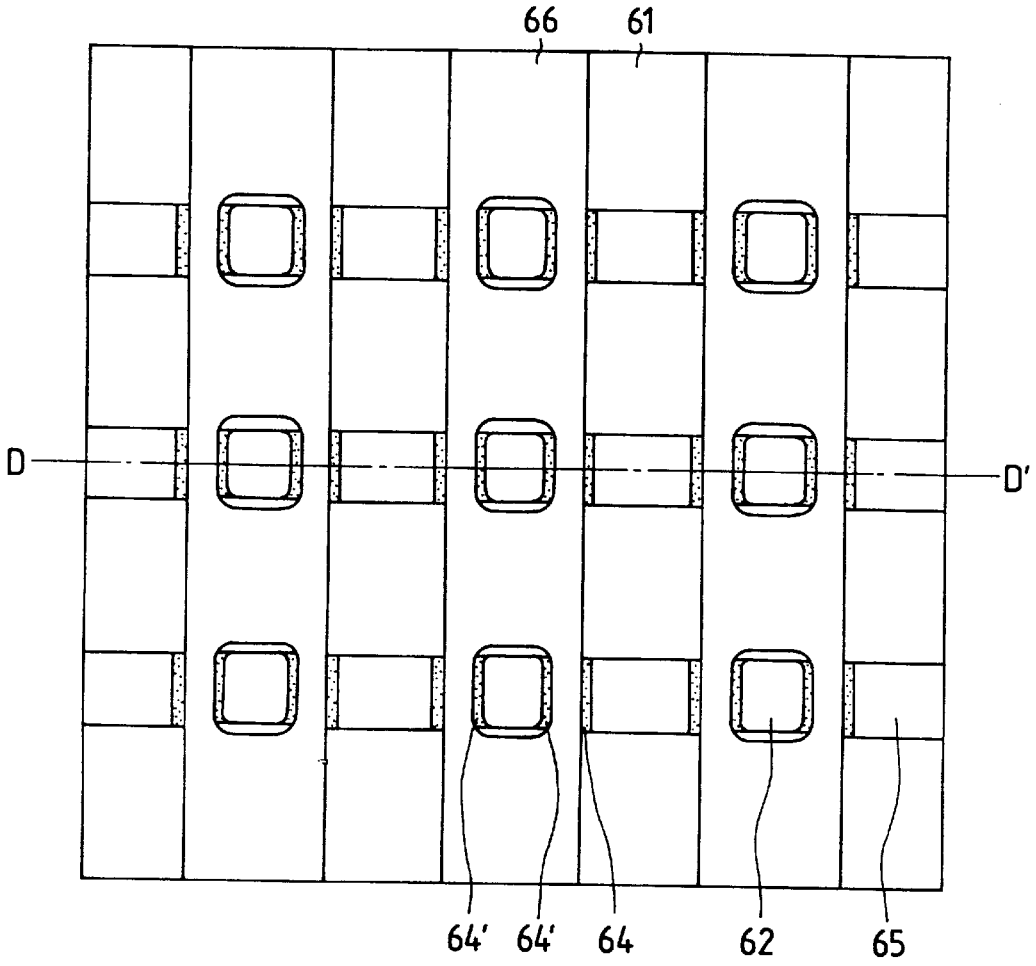
FIGS. 25A and 25B are schematic partial plan and side views of the electron source of a seventh embodiment of the image-forming apparatus according to the invention.
Figure 25B:
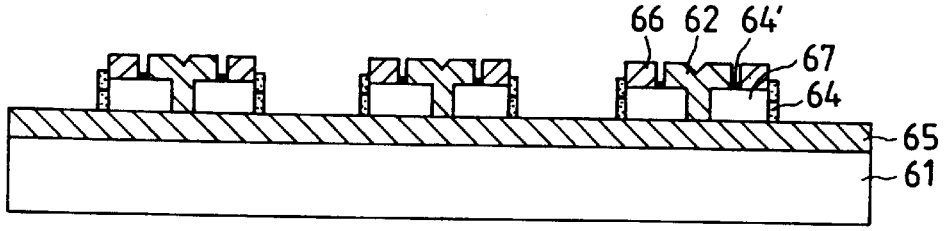

FIGS. 25A and 25B are schematic view of a seventh embodiment of electron source according to the invention, of which FIG. 25A is a plan view and FIG. 25B is a sectional view taken along line D–D' of FIG. 25A. This embodiment differs from the above sixth embodiment in that an additional thin film 64 including an electron-emitting region is formed between the auxiliary electrode 62 on the insulation layer and the X-directional wire 65 at each wire crossing.

This embodiment is characterized in that, since every electron-emitting device comprises four electron-emitting regions, electron beams are emitted from each device at an enhanced rate incessantly and converged well even if all the electron-emitting regions do not operate well after the forming operation. Additionally, since each device emits electron beams at a high rate and the emitted beams are converged well, each electron-emitting device can be downsized to achieve a given electron beam emission rate and hence a large number of devices can be arranged densely per unit area.

Embodiment 8

An electron source as illustrated in FIGS. 7A and 7 B and described earlier is prepared, following the manufacturing steps described below by referring to FIGS. 26A through 26E.

Figure 26A:
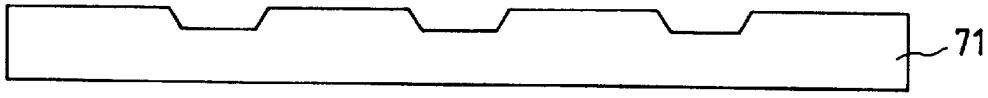
FIGS. 26A through 26E schematically illustrate different steps of manufacturing the electron source of FIGS. 7A and 7B.

(1) After thoroughly cleansing a quartz insulator substrate 71 with an organic solvent, photoresist (AZ1370 available from HECHST) is applied thereto while turning the substrate by means of a spinner and then the applied photoresist is baked. Then, the photoresist layer is exposed to light through a photomask and photochemically developed to produce a resist pattern for grooves and, thereafter, grooves are formed on the substrate along the X-direction to a depth of 5,000 Å by IE (Reactive Ion Etching), using $CH_4$ and $H_2$ gases (FIG. 26A).

Figure 26B:
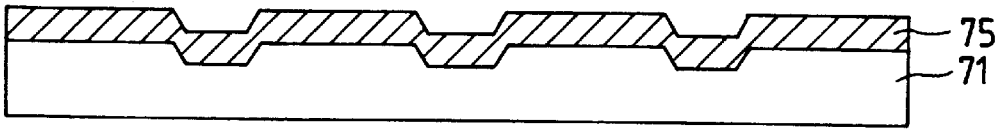

(2) Subsequently, a Cr layer and an Au layer are sequentially formed on the substrate 71 to respective thicknesses of 50 Å and 6,000 Å by vacuum deposition. Then, photoresist is applied thereto while turning the substrate by means of a spinner and the applied photoresist is baked. Thereafter, the photoresist layer is exposed to light and photochemically developed to produce a resist pattern for Y-directional wires 75 and then the Au and Cr layers are wet-etched to produced Y-directional wires 75 (FIG. 26B).

Figure 26C:
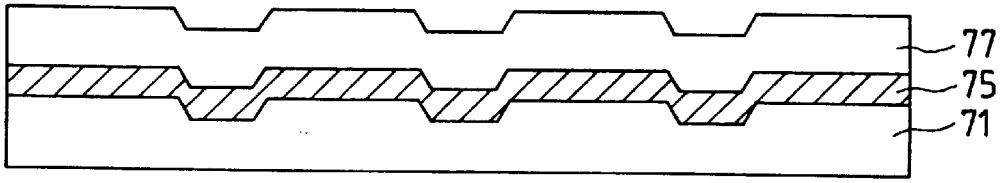

(3) An insulation layer 77 made of $SiO_2$ is formed to a thickness of 1 μm on the entire surfaces of all the Y-directional wires 75 by RF sputtering (FIG. 26C).

(4) Photoresist is applied to the surface of the substrate while turning the substrate by means of a spinner and the applied photoresist is baked. Thereafter, the photoresist layer is exposed to light and photochemically developed to produce a resist pattern for X-directional wires 76 and then Ni is deposited thereon to a thickness of 1.0 μm by vacuum deposition.

Figure 26D:
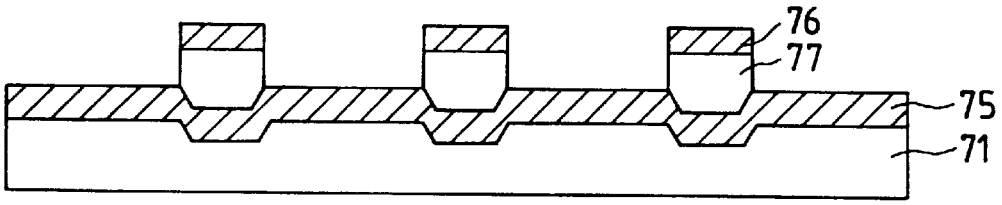

(5) The insulation layer is etched by RIE to produce inter-layer insulation layers, using the Ni deposition film as a mask and also $CH_4$ and $H_2$ gases (FIG. 26D).

Figure 26E:
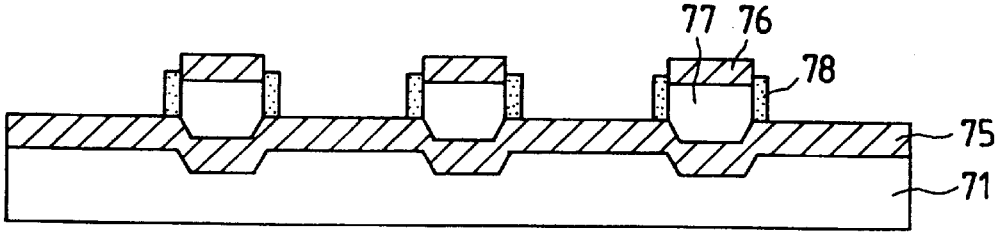

(6) After forming a Cr film to a thickness of 0.1 μm by vapor deposition, photoresist is applied thereto while turning the substrate by means of a spinner and then the applied photoresist is baked. Thereafter, the photoresist layer is exposed to light and photochemically developed to produce a resist pattern for thin films including electron-emitting regions. After removing the resist pattern, organic Pd Solution (ccp4230: available from Okuno Pharmaceutical Co., Ltd.) is applied thereto by means of a spinner. Then, the coated substrate is baked and thin films 78 for forming electron-emitting regions are formed by etching off, using Cr (FIG. 26E).

(7) The substrate is then put into a vacuum chamber having a degree of vacuum of $10^{-6}$ Torr and a forming voltage of 5V is applied to the X- and Y-directional wires for 60 seconds to energize the thin films 78 of fine particles for forming electron-emitting regions to irreversibly transform the films of fine particles and thus produce electron-emitting regions.

When voltages of 0V and 14V are applied respectively to a selected one of the X-directional wires 76 and a selected one of the Y-directional wires 75, while 7V is applied to all the remaining X- and Y-directional wires, only the electron-emitting devices at the wire crossing specified by the X- and Y-directional wires emits electrons to prove the excellent selectivity of the embodiment.

The embodiment produced through the above manufacturing steps operates excellently for electron beam emission and hence does not show any remarkable reduction in the yield if it is used for a large high definition screen.

The capacitance of each wire crossing of the embodiment is reduced by 30 to 40% when compared with an electron source having no grooves on the substrate so that the cut-off frequency is raised by 30 to 40%.

Embodiment 9

Figure 27:
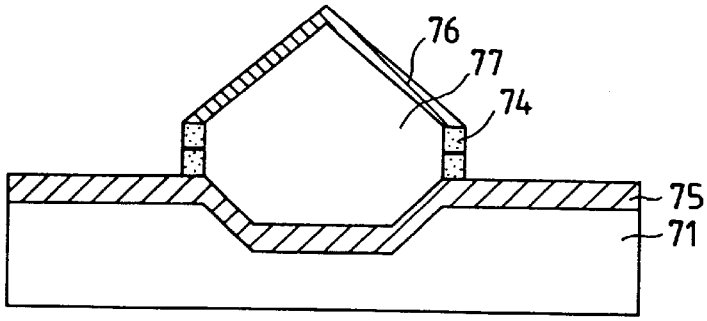
FIG. 27 is a schematic partial plan view of the electron source of a ninth embodiment of the image-forming apparatus according to the invention.

FIG. 27 is a schematic partial sectional view of a ninth embodiment of an electron source according to the invention. This embodiments is realized by following the manufacturing steps of the above described eighth embodiment except that the step (1) is omitted and, after forming an insulation layer in step (3), the insulation layer is processed by means of photolithography and etching to shape individual insulation layers so that each insulation layer 77 shows a sectional view having a projection if taken along the Y-directional wire 75. When this embodiment is driven in a manner as described above for the eighth embodiment, it operates as effectively as the above embodiment.

Embodiments 10 through 12

Figure 28:
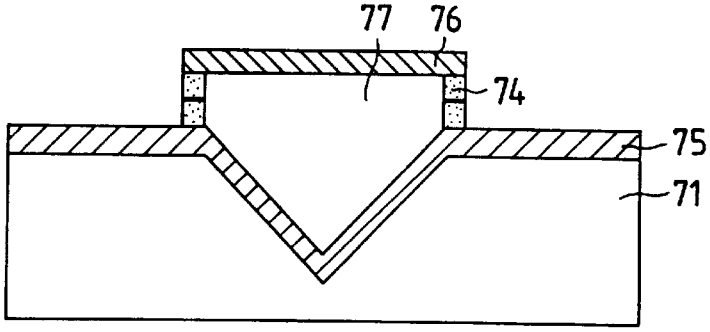
FIG. 28 is a schematic partial plan view of the electron source of a tenth embodiment of the image-forming apparatus according to the invention.
Figure 29:
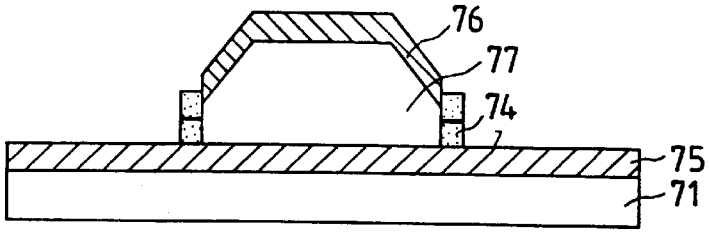
FIG. 29 is a schematic partial plan view of the electron source of an eleventh embodiment of the image-forming apparatus according to the invention.
Figure 30:
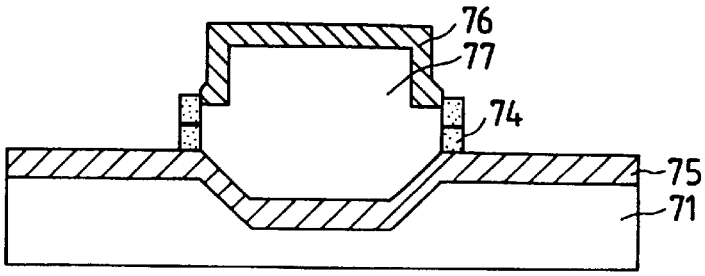
FIG. 30 is a schematic partial plan view of the electron source of a twelfth embodiment of the image-forming apparatus according to the invention.

FIGS. 28 through 30 are schematic partial sectional views taken along an X-directional wire of the tenth through twelfth embodiments of the invention. Each of the embodiments is produced through the manufacturing steps as described above for the eighth and ninth embodiments.

Each of the above described sixth through twelfth embodiments can be used for an image-forming apparatus as in the case of the first embodiment to prove that it operates excellently for electron beam emission and hence does not show any remarkable reduction in the yield if it is used for a large high definition screen.

Furthermore, each of the above described sixth through twelfth embodiments can be used as an electron source of an image-forming apparatus that operates for displaying various images provided by television broadcasting and other image sources in a manner as illustrated in FIG. 18.

As described above in detail, the present invention provides an electron source that does not require device electrodes and an image-forming apparatus incorporating such an electron source. Thus, the present invention offers, among others, the following advantages.

(1) Realization of a finely defined electron source comprising densely arranged election-emitting devices.

(2) Realization of a simplified and economized manufacturing process with a reduced number of manufacturing steps.

(3) High precision processing throughout the manufacturing steps and a high yield and reproducibility.

(4) Realization of a simply configured electron source with excellent luminance and image display capabilities.

(5) Enhanced controllability of the intensity of electron beam irradiation on the image-forming screen and formation of highly symmetrical luminous spots.

(6) A reduced capacitance of the wire crossings and a high speed drive capability.

What is claimed is:

1. A method of producing an image forming apparatus comprising the steps of:

(A) providing a first substrate on which an electron source is disposed, the electron source comprising a plurality of row-directional wires, a plurality of column-directional wires crossing the row-directional wires to form a plurality of intersections, an insulating layer disposed between the row-directional wires and the column-directional wires at each intersection, and a plurality of electron emitting sections disposed on the insulating layers at the intersections and electrically connected to the row-directional wires and the column-directional wires;

(B) providing a second substrate on which an anode is disposed;

(C) arranging a space between the first and second substrates and maintaining the space at a reduced pressure;

(D) connecting a driver for driving the electron source to the row-direction wires and the column-direction wires; and (E) connecting a direct-current power source to the anode.

2. A method of producing an image forming apparatus comprising the steps of:

(A) providing a first substrate on which an electron source is disposed, the electron source comprising a plurality of row-directional wires, a plurality of column-directional wires crossing the row-directional wires to form a plurality of intersections, an insulating layer disposed between the row-directional wires and the column-directional wires at each intersection, and a plurality of electron emitting sections disposed at the intersections so that at least two electron emitting sections are disposed at each intersection and electrically connected to the row-directional wires and the column-directional wires;

(B) providing a second substrate on which an anode is disposed;

(C) arranging a space between the first and second substrates and maintaining the space at reduced pressure;

(D) connecting a driver for driving the electron source to the row-direction wires and the column-direction wires; and (E) connecting a direct-current power source to the anode.

* * * * *

UNITED STATES PATENT AND TRADEMARK OFFICE

CERTIFICATE OF CORRECTION

PATENT NO. : 6,409,566 B1 
DATED : June 25, 2002
INVENTOR(S) : Mitsutoshi Hasegawa et al.

It is certified that error appears in the above-identified patent and that said Letters Patent is hereby corrected as shown below:

Title page,
Item [56], References Cited, OTHER PUBLICATIONS, in "M. I. Elison, et al.," "Phsyics," should read -- Physics --.

Column 1,
Line 32, "thin-film filed emission cathode with molybdenum cones"," should read -- Thin-film Field Emission Cathode with Molybdenum Cones", --
Line 34, ""The tunnel emission amplifier"," should read -- The Tunnel Emission Amplifier", --.

Column 3,
Line 46, "ds" should read -- as --.

Column 18,
Line 36, "applied." should read -- applied --.
Line 59, "$K_2 \times 2H(Vf/Va)^{1/2} \geqq D/2 \geqq K_3 \times 2H(Vf/Va)^{1/23}$" should read
-- $K_2 \times 2H(Vf/Va)^{1/2} \geqq D/2 \geqq K_3 \times 2H(Vf/Va)^{1/2}$ --.

Column 27,
Line 24, "wire wires" should read -- wires --.

Signed and Sealed this

Twenty-first Day of January, 2003

JAMES E. ROGAN
*Director of the United States Patent and Trademark Office*